United States Patent [19]

Murai et al.

[11] Patent Number: 5,060,926

[45] Date of Patent: Oct. 29, 1991

[54] SHEET FEEDER FOR AN IMAGE FORMING APPARATUS

[75] Inventors: Tatsuya Murai, Yokohama; Masumi Ikesue; Mitsutoyo Kikuno, both of Tokyo; Masayuki Shinada, Yokohama, all of Japan

[73] Assignee: Ricoh Company, Ltd., Tokyo, Japan

[21] Appl. No.: 424,770

[22] Filed: Oct. 19, 1989

[30] Foreign Application Priority Data

Oct. 20, 1988 [JP] Japan ..... 63-264671

[51] Int. Cl.[5] ..... B65H 3/06

[52] U.S. Cl. ..... 271/111; 271/117

[58] Field of Search ..... 271/110, 111, 117, 171

[56] References Cited

U.S. PATENT DOCUMENTS

| | | | |
|---|---|---|---|
| 4,098,501 | 7/1978 | Tani | 271/117 |
| 4,406,447 | 9/1983 | Fichte | 271/117 X |
| 4,529,189 | 7/1985 | Konishi | 271/117 X |
| 4,558,858 | 12/1985 | Runzi | 271/117 X |

*Primary Examiner*—Richard A. Schacher

*Attorney, Agent, or Firm*—Oblon, Spivak, McClelland, Maier & Neustadt

[57] ABSTRACT

A sheet feeder for an image forming apparatus having a sheet feed unit which incorporates a pair of feed rollers for feeding paper sheets one by one out of at least one sheet cassette toward an image transfer station by nipping them. The sheet feed unit is automatically moved by a guide to a position where the feed rollers align with the intermediate between opposite widthwise edges of the paper sheets.

12 Claims, 39 Drawing Sheets

START
ST505
1ST TRAY SET SIGNAL ON ?
NO
RET
YES
ST506
1ST TRAY LOWER SW ON ?
YES
NO
ST507
1ST TRAY PAPER END SENSOR (PS2) ON ?
YES
NO
ST511
FLAG DFEND1 SET ?
NO
RET
YES
ST512
1ST TRAY UPPER LIMIT SENSOR (PS3) ON ?
YES
NO
ST513
ELEVATE 1ST TRAY MOTOR, CW SIGNAL ON
ST514
1ST TRAY MOTOR OFF
RET
ST508
1ST TRAY LOWER LIMIT SENSOR (PS4) ON ?
YES
NO
ST509
LOWER 1ST TRAY MOTOR, CCW SIGNAL ON
ST510
1ST TRAY MOTOR ON
RET

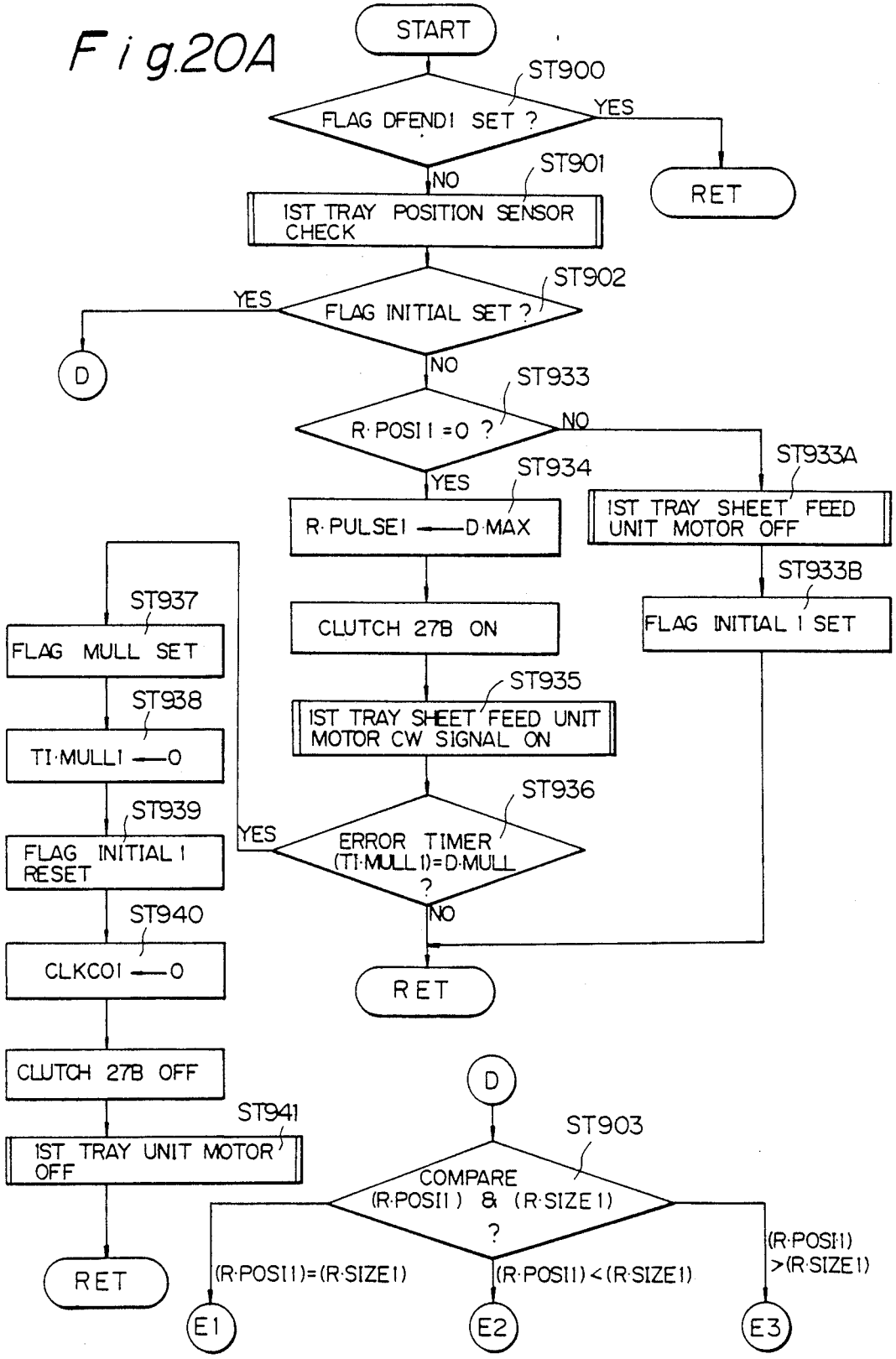
Fig.20A
START
ST900
FLAG DFEND1 SET ?
YES
RET
NO
ST901
1ST TRAY POSITION SENSOR CHECK
ST902
FLAG INITIAL SET ?
YES
D
NO
ST933
R·POSI1 =0 ?
NO
ST933A
1ST TRAY SHEET FEED UNIT MOTOR OFF
ST933B
FLAG INITIAL 1 SET
YES
ST934
R·PULSE1 —— D·MAX
CLUTCH 27B ON
ST935
1ST TRAY SHEET FEED UNIT MOTOR CW SIGNAL ON
ST936
ERROR TIMER (TI·MULL1)=D·MULL ?
YES
NO
RET
ST937
FLAG MULL SET
ST938
TI·MULL1 —— 0
ST939
FLAG INITIAL 1 RESET
ST940
CLKCO1 —— 0
CLUTCH 27B OFF
ST941
1ST TRAY UNIT MOTOR OFF
RET
D
ST903
COMPARE (R·POSI1) & (R·SIZE1) ?
(R·POSI1)=(R·SIZE1)
(R·POSI1)<(R·SIZE1)
(R·POSI1) >(R·SIZE1)
E1
E2
E3

SHEET FEEDER FOR AN IMAGE FORMING APPARATUS

BACKGROUND OF THE INVENTION

The present invention relates to an image forming apparatus and, more particularly, to the structure of a sheet feeder installed in an image forming apparatus.

A facsimile machine, laser printer or similar image forming apparatus is often constructed to produce a reproduction by transferring a visible image formed on a photoconductive element to a plain paper or similar sheet material. A prerequisite with such image transfer is, therefore, that a paper sheet be accurately transported into register with the image on the photoconductive element. A sheet feeder is generally installed in this kind of apparatus for implementing such a manner of sheet feed. The sheet feeder may be of the type including an elevatable table which is loaded with a stack of paper sheets, and pull-out rollers engageable with the paper sheet located at the top of the stack. A guide member is provided at at least one side edge of the table which extends in the widthwise direction of the paper sheets. The guide member is movable along the width of the table to regulate the side edges of the sheet stack on the table, whereby the paper sheets are fed one by one while being protected against skew.

In the sheet feeder of the type having a guide member as stated above, paper sheets are transported, i.e., they are stacked on the table by using either one of two different reference positions which are the center and one side. Specifically, paper sheets are stacked on the table with the intermediate between opposite widthwise edges thereof, or center, being positioned at the widthwise center of the table, or with their one widthwise edge being positioned on the table with no regard to the sheet size. In the center reference scheme, the feed rollers and the paper sheets are held in a constant relationship. This is successful in freeing the rollers of the transport mechanism from uneven wear and preventing the transporting force from becoming irregular in the widthwise direction. However, documents have to be set in matching relation to the reference for the paper sheets by troublesome manipulations. In addition, it is difficult to remove a jamming sheet. In contrast, the one side reference scheme promotes easy document setting and allows a jamming sheet to be removed with ease, because it uses a fixed reference position with no regard to the sheet size. A problem with this alternative scheme, however, is that the pull-out rollers contact only one side of the paper sheet at all times and therefore suffer from uneven wear, degrading the accuracy of paper transport.

SUMMARY OF THE INVENTION

It is therefore an object of the present invention to provide a sheet feeder for an image forming apparatus which promotes easy manipulation and accurate sheet transport by simple processing.

It is another object of the present invention to provide a generally improved sheet feeder for an image forming apparatus.

A sheet feeder for an image forming apparatus having a sheet feed unit which incorporates a pair of feed rollers for feeding paper sheets one by one out of at least one sheet cassette toward an image transfer station by nipping the paper sheets of the present invention comprises a guide for slidably guiding the sheet feed unit in a direction perpendicular to an intended direction of sheet feed while supporting the sheet feed unit, a driver for moving the sheet feed unit which is guided by the guide, and a controller for controlling the guide and driver such that the sheet feed unit is movable to cause the feed rollers into alignment with intermediate between opposite widthwise edges of the paper sheets in association with a size of the paper sheets which are fed toward the image transfer station.

BRIEF DESCRIPTION OF THE DRAWINGS

The above and other objects, features and advantages of the present invention will become more apparent from the following detailed description taken with the accompanying drawings in which:

FIGS. 14A, 14B, 15A, 15B, 15C, 16, 17, 18, 19A, 19B, 19D, 19D, 19E, 19F, 20A, 20B, 20C, 20D, 21, 22, 23, 24A, 24B, 25A, 25B, 26A and 26B are flowcharts demonstrating specific operations of the control circuitry shown in FIG. 11.

DESCRIPTION OF THE PREFERRED EMBODIMENT

Referring to FIGS. 1 to 10 of the drawings, a sheet feeder embodying the present invention and an image forming apparatus incorporating it are shown. In the illustrative embodiment, the image forming apparatus is implemented as an electrophotographic copier by way of example. The copier, generally 1, has a body shown in FIG. 1, and a photoconductive element in the form of a drum 1A accommodated in the body and rotatable as indicated by an arrow in the figure. A main charger 1B, optics 1C for imagewise exposure, a developing unit 1D, a transfer and separation unit 1E and a cleaning unit 1F are arranged around the drum 1A in this sequence with respect to the direction of rotation of the drum 1A. A sheet feed path 1G faces the front end of the transfer and separation unit 1E with respect to the direction of rotation of the drum 1A, so that a paper sheet may be fed from a sheet feeder 2 which will be described. A fixing unit 1H is located at the rear of the transfer and separation unit 1E in order to fix a toner image on a paper sheet which has been separated from the drum 1A after image transfer. The optics 1C may include a scanner movable in a reciprocating motion and having any conventional structure. Specifically, the optics 1C scan an original document which is laid on a glass platen 1C1 and thereby form an electrostatic latent image representative of the document on the drum 1A.

Figure 1:
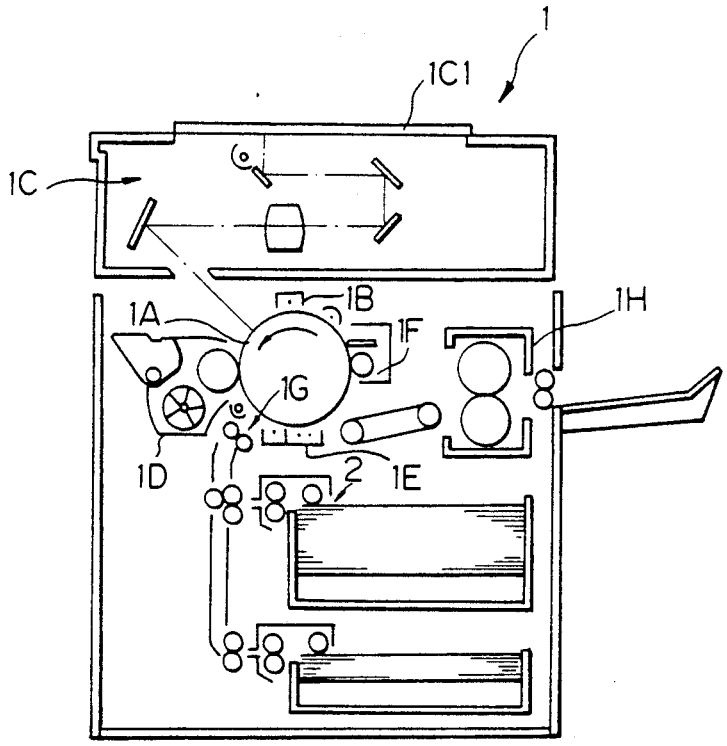
FIG. 1 is a view schematically showing an image forming apparatus to which a sheet feeder embodying the present invention is applied.
Figure 2:
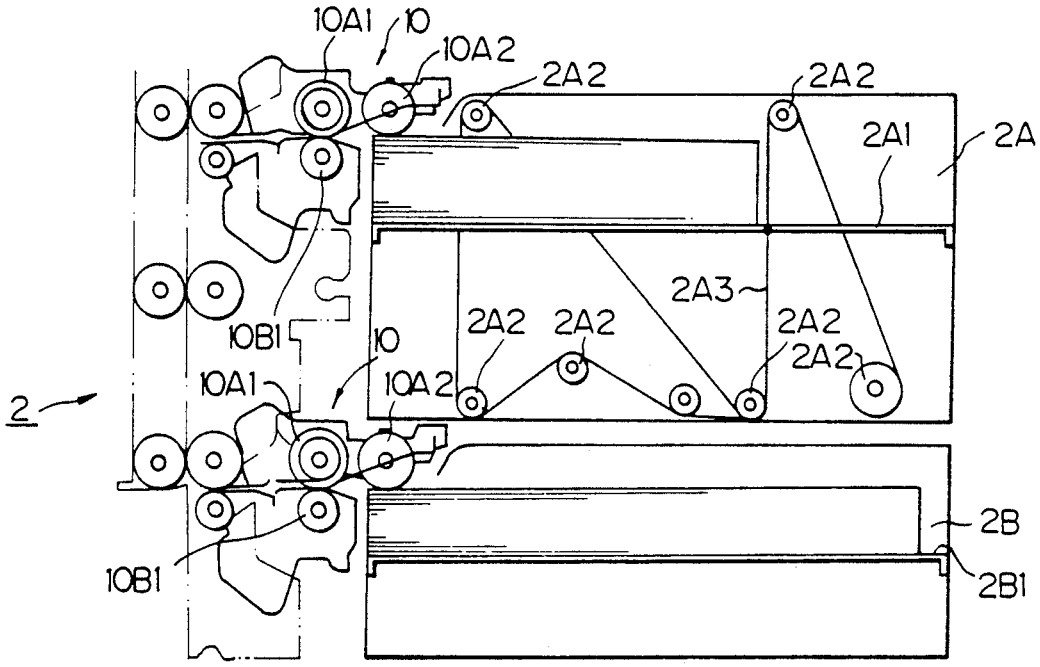
FIG. 2 is a side elevation of the sheet feeder installed in the apparatus of FIG. 1.

FIG. 2 shows the sheet feeder 2 of the illustrative embodiment in detail. The sheet feeder 2 includes, for example, sheet cassettes 2A and 2B each being loaded with a different kind of paper sheet. The sheet cassettes 2A and 2B have trays or tables 2A1 and 2B1, respectively, each being moved up and down by a mechanism which will be described with reference to FIG. 3. It is to be noted that the construction and arrangement which will be described with reference to FIG. 3 and successive drawings are included in each of the sheet cassettes 2A and 2B, although the description will concentrate on the cassette 2A only.

A plurality of pulleys 2A2 are rotatably mounted on a side wall of a body of the sheet feeder 2, while a wire 2A3 is passed over the pulleys 2A2 crosswise. A pair of elevatable guide shafts 2A4 and 2A5 (see FIG. 3) are individually affixed to a part of the wire 2A3 and are loaded with the table 2A1. One of the pulleys 2A2 on the side wall is driven in a rotary motion to move the table 2A1 up or down. The sheet cassette 2A accommodating the table 2A1 thereinside has side walls at opposite widthwise ends of the paper sheet which are stacked on the table 2A1. A pair of guide shafts 2A6 are supported by the side walls of the table 2A1 and extend parallel to each other in the widthwise direction of the paper sheets. A guide member 3 is mounted on one end portion of the guide shafts 2A6.

Figure 3:
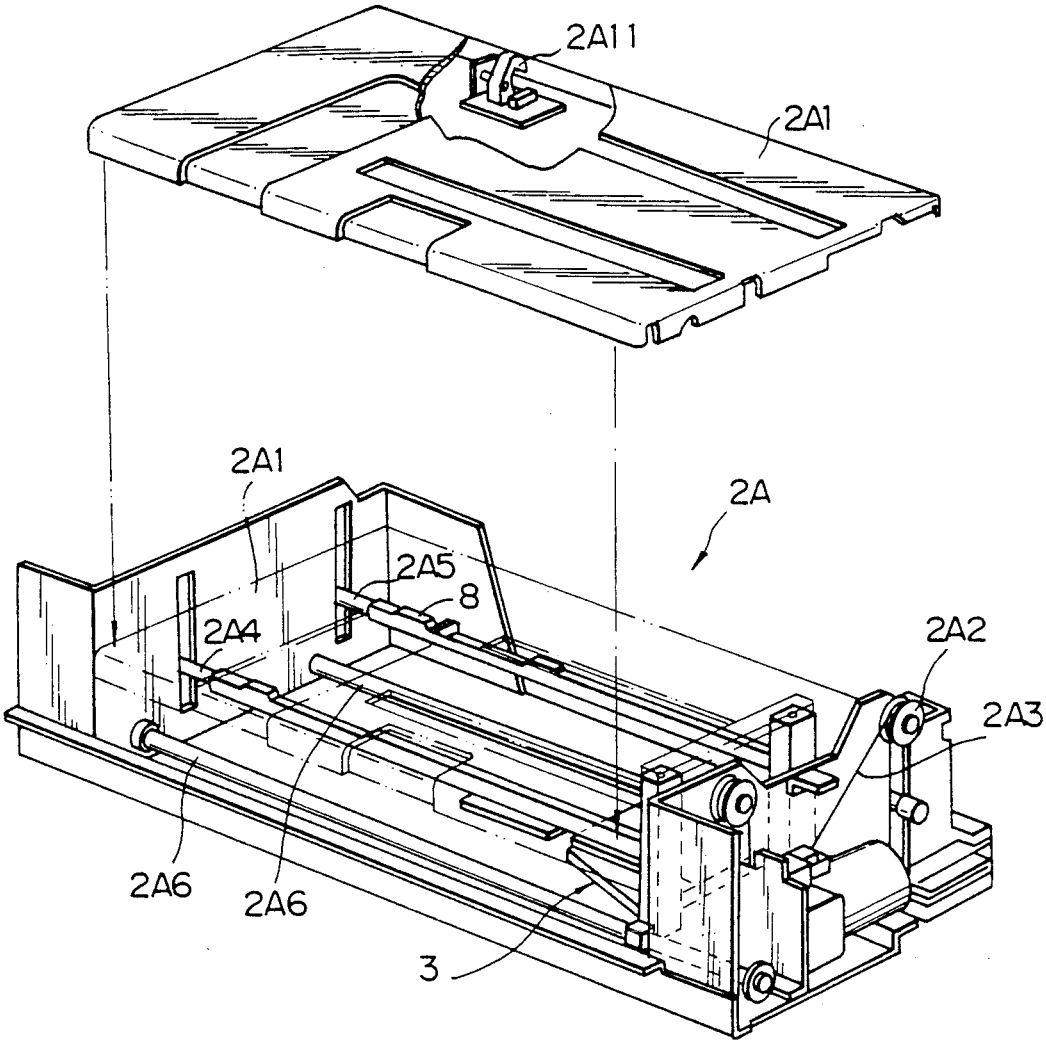
FIG. 3 is a fragmentary perspective view of a sheet cassette included in the illustrative embodiment.
Figure 4:
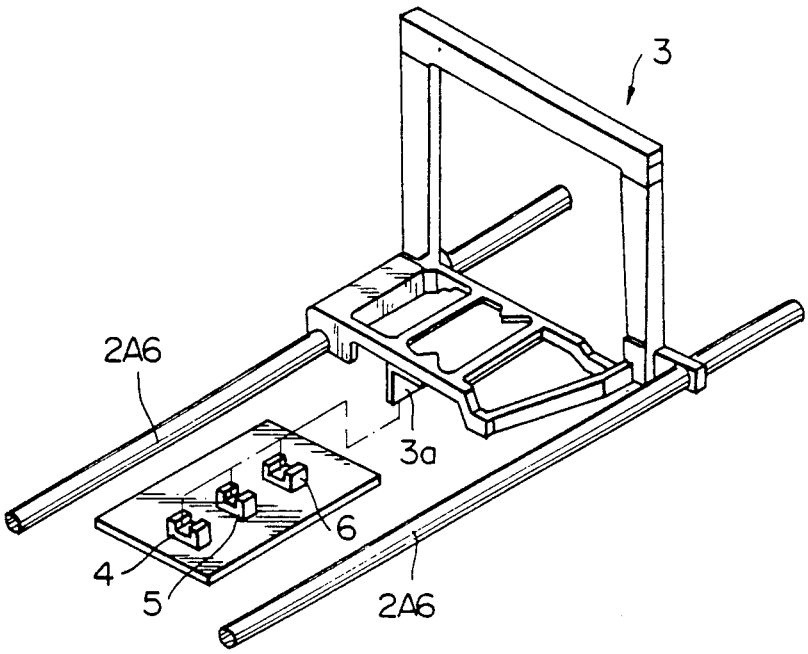
FIG. 4 is a fragmentary perspective view of the sheet cassette shown in FIG. 3.

As shown in FIGS. 3 and 4, the guide member 3 extends from one guide shaft 2A6 to the other guide shaft 2A6 spanning the space therebetween and is slidable on and along the guide shafts 2A6. By so sliding, the guide member 3 abuts against and thereby regulates one widthwise edge of the sheet stack which is loaded on the table 2A1. As shown in FIG. 4, a feeler 3*a* extends downward from the bottom of the guide member 3 and is implemented as a bent piece. Size sensors 4, 5 and 6 are arranged on the sheet cassette 2*a* along the locus of movement of the feeler 3*a* for sensing the position of the guide member 3. In this configuration, the width or size of the paper sheets stacked on the table 2A1 is sensed on the basis of the correspondence between the sensors 4, 5 and 6 and the feeler 3*a*.

Figure 5:
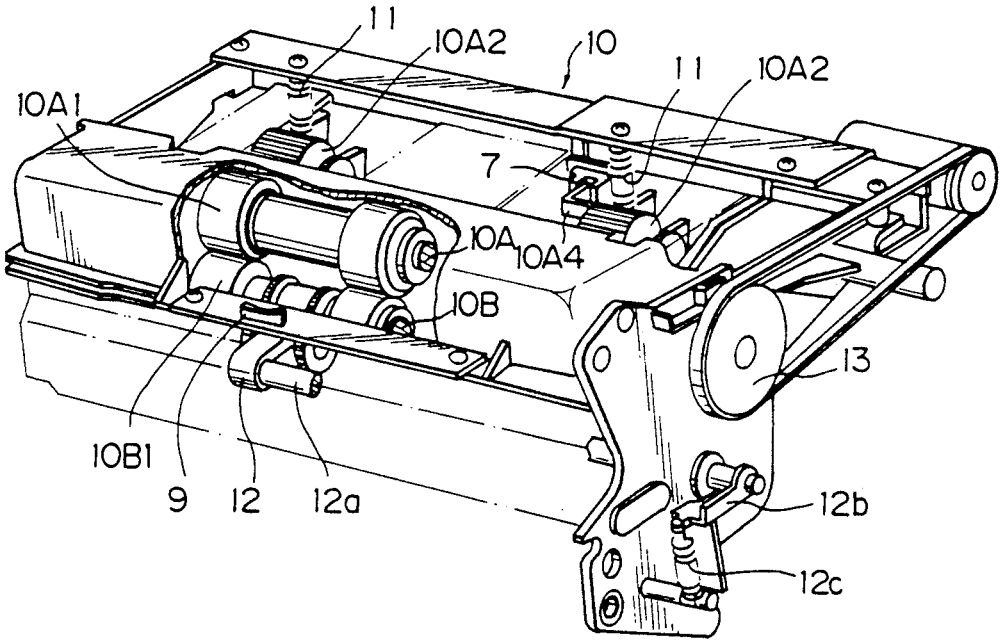
FIG. 5 is a fragmentary perspective view of a sheet feed unit mounted on the cassette of FIG. 3.
Figure 6:
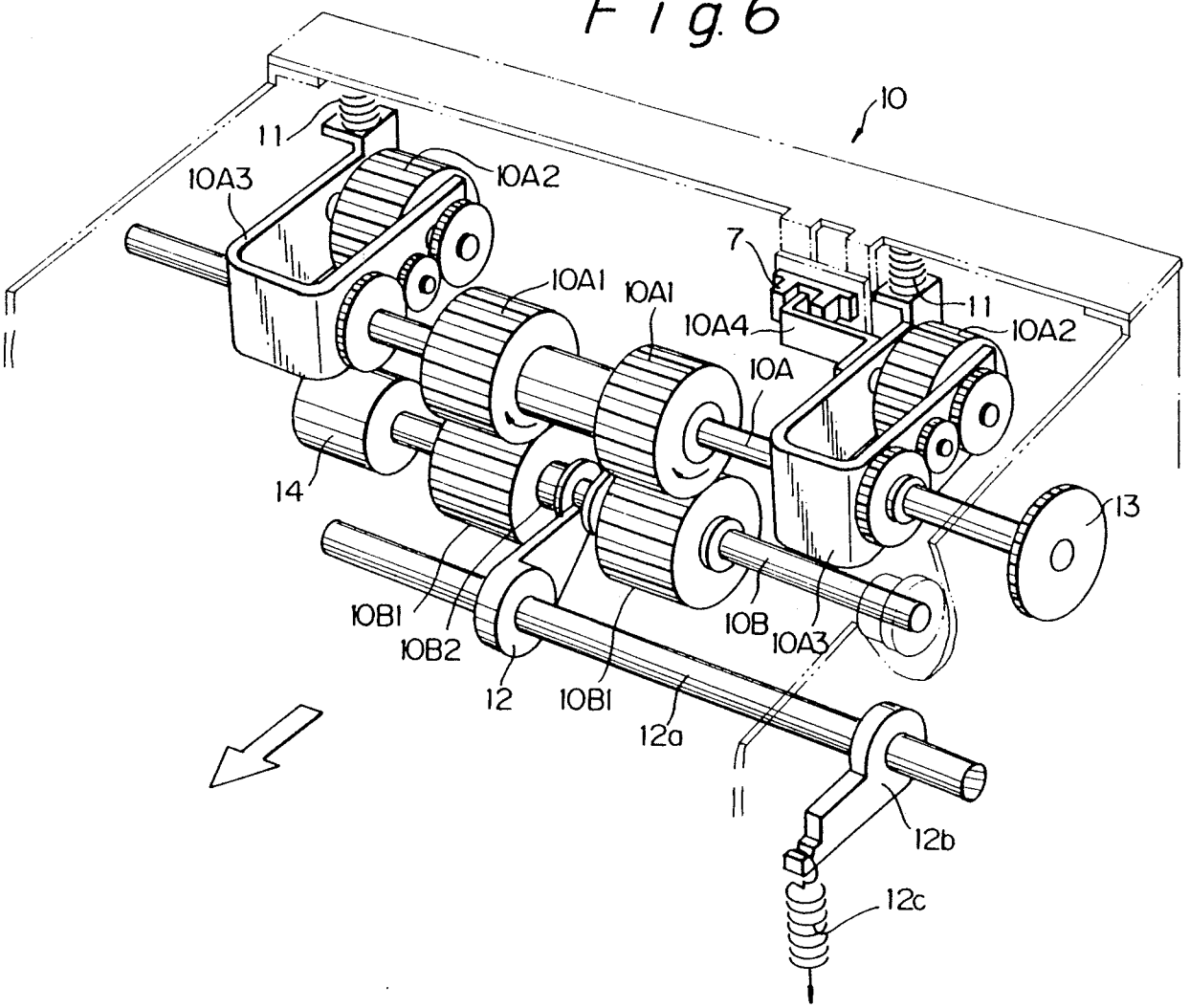
FIG. 6 is a perspective view showing a specific construction of a drive system applicable to the sheet feed unit of FIG. 5.

A sheet feed unit 10 is associated with the sheet cassette 2A and has therein an upper limit sensor 7, see FIGS. 5 and 6, a lower limit sensor 8, FIG. 3, a paper end sensor 2A11, FIG. 3, and a sheet feed sensor 9, FIG. 5. The upper limit sensor 7 defines a timing for causing paper sheets on the table 2A1 into abutment against pull-out rollers. The lower limit sensor 8 senses, when paper sheets are newly stacked on the table 2A1, the lowered position of the table 2A1 in cooperation with a screening plate, not shown, which is mounted on one 2A5 of the guide shafts. The paper end sensor 2A11 senses the presence of paper sheets on the table 2A1 when pressed by the latter. The sheet feed sensor 9 defines a transport time of the paper sheet fed out by the pull-out rollers. The upper limit sensor 7 and paper feed sensor 9 will be described specifically in relation to the sheet feed unit 10.

As shown in FIGS. 2, 5 and 6, the sheet feed unit 10 is located at the sheet outlet side of the sheet feeder 2. An upper and a lower shaft 10A and 10B are journalled to opposite side walls of the sheet feed unit 10. Feed rollers 10A1 and pull-out rollers 10A2 are mounted on the upper shaft 10A, while separating rollers 10B1 are mounted on the lower shaft 10B and pressed against the feed rollers 10A1. The feed rollers 10A1 and the separating rollers 10B1 are rotatable in opposite directions to each other. Specifically, as shown in FIG. 6, the feed rollers 10A1 are rotated in a direction for feeding out a paper sheet, while the separating rollers 10B1 are rotated in a direction for returning a paper sheet toward the table 2A1. Regarding the coefficient of friction, it is predetermined that the feed rollers 10A1 are greater than the separating rollers 10B1 which are in turn greater than the paper sheets. In such a configuration, when two or more paper sheets are driven at the same time, the feed rollers 10A1 feed only one paper sheet at a time.

As shown in FIG. 6, the pull-out rollers 10A2 are each rotably mounted on a holder or bracket 10A3 which is mounted to be angularly movable on the upper shaft 10A. A gearing including a gear which is mounted on the shaft 10A drives the pull-out rollers 10A2 in the same direction as the feed rollers 10A1. A compression spring 11 is preloaded between the top plate of the sheet feed unit 10 and the free end of each holder 10A3, whereby the associated pull-out roller 10A2 is constantly biased toward the upper end of the sheet stack. A screening plate 10A4 implemented as a bent feeler extends sideways from the free end of the holder 10A3 to operate the upper limit sensor 7 which is mounted on the sheet feed unit 10. More specifically, while the holder 10A3 is sequentially lowered due to the consumption of paper sheets or while the table 2A1, FIG. 2, is sequentially elevated, the screening plate 10A4 operates the upper limit sensor 7 when the table 2A1 reaches a predetermined position where it abuts against the pull-out rollers 10A2 or where it runs out of paper sheets. A bush 10B2 is provided on the lower shaft 10B for mounting the separating rollers 10B1 on the shaft 10B. A pressing arm 12 is rigidly mounted on a shaft 12*a* and held in contact with the lower end of the bush 10B2. A biasing arm 12*b* is rigidly mounted at one end to the shaft 12*a*, while a tension spring 12*c* is anchored at one end to the free end of the biasing arm 12*b*. In this construction, the arm 12 is pressed against the bush 10B2 by the spring 12*c* resulting in the separating rollers 10B1 being constantly biased toward the feed rollers 10A1.

A pulley 13 is mounted on one end of the upper shaft 10A and is driven by a sheet feed motor, which will be described, to in turn drive the feed rollers 10A1 in a rotary motion. A drive motor, not shown, drives the separating rollers 10B1 via a one-way clutch 14 which is mounted on one end of the lower shaft 10B. The one-way clutch 14 promotes sure separation of a paper sheet by preventing the separating rollers 10B1 from following the rotation of the feed rollers 10A1. Hence, while the feed rollers 10A1 do not feed paper sheets, the separating rollers 10B1 are rotatable in the same direction as the feed rollers 10A1 in contact with the latter. As shown in FIG. 5, the sheet feed sensor 9 is located at the rear of the feed rollers 10A1 with respect to the intended direction of sheet feed. When the sheet feed sensor 9 senses the feed of a paper sheet, it causes the paper sheet to stop for a moment and then driven again. This allows the trailing edge of a paper sheet to be fed without delay.

Figure 7:
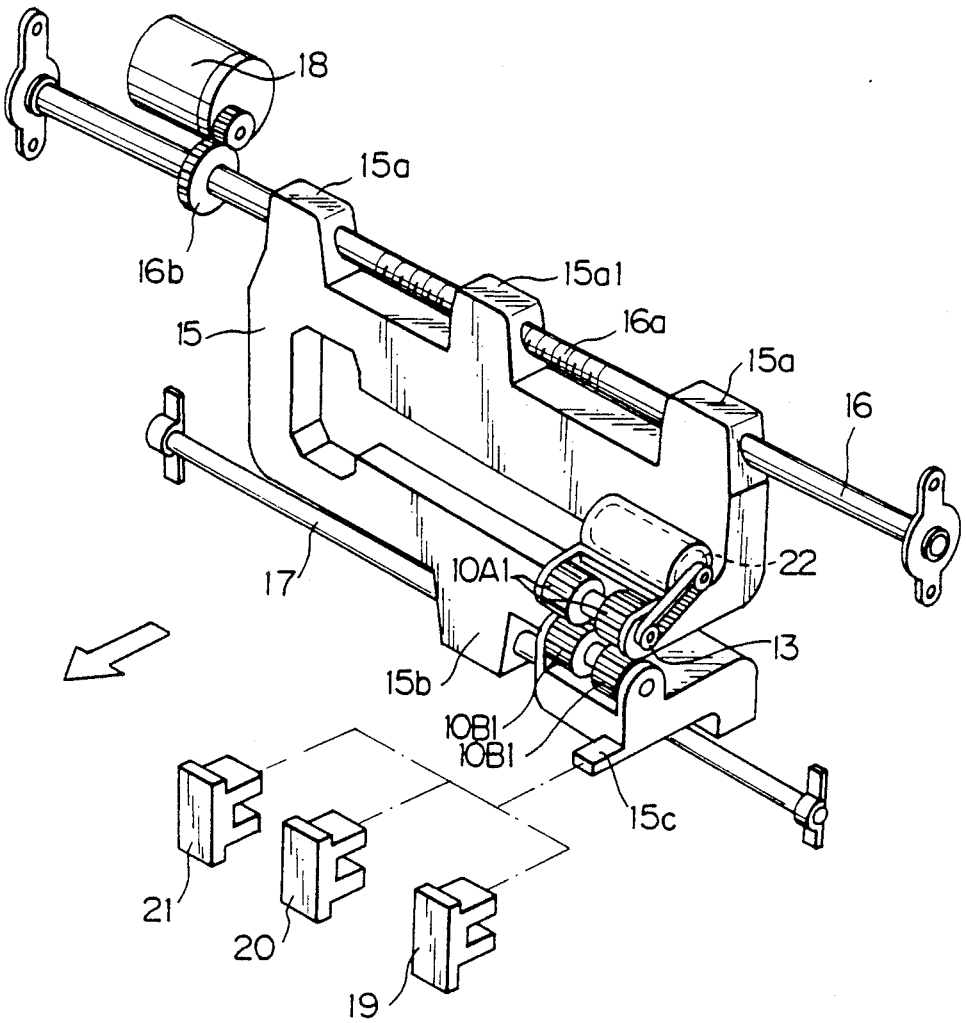
FIG. 7 is a perspective view showing a specific construction of a drive system associated with the movement of the sheet feed unit shown in FIG. 5.

The sheet feed unit 10 is bodily movable in the widthwise direction of paper sheets within the sheet cassette 2A or 2B, as will be described in detail with reference to FIGS. 7 to 10. FIG. 7 shows a specific structure for supporting the feed rollers 10A1 and separating rollers 10B1. In FIG. 7, the sheet feed unit 10 has a bracket 15 which is generally horseshoe-shaped as viewed from the rear with respect to the intended direction of paper feed which is indicated by an arrow. The feed rollers 10A1 and separating rollers 10B1 are mounted face-to-face on the front end of the open side of the bracket 15. More specifically, the support bracket 15 has bearing portions 15*a*, 15*a*1 and 15*b*. Parallel support shafts 16 and 17 are supported at opposite ends thereof by opposite side walls, not shown, of the sheet cassette 2A or 2B and extend throughout the bearing portions 15*a*, 15*a*1 and 15*b* of the bracket 15. The bracket 15, therefore, is slidable on and along the shafts 16 and 17 in the widthwise direction of paper sheets. The shaft 16 has a threaded portion 16*a* with which one 15*a*1 of the bearing portions is engaged. A gear 16*b* is affixed to the shaft 16 and driven by a motor 18 to in turn rotate the shaft 16, whereby the bracket 15 is caused to slide through the threaded portion 16*a*.

A flange-like screening plate 15*c* extends rearward from a bracket which is associated with the bracket 15 and is adapted to support the separating rollers 10B1. Sheet width sensors 19, 20 and 21 are arranged on the sheet cassette 2A or 2B along the locus of movement of the screening plate 15*c*. Electrically connected to the motor 18, the sheet width sensors 19, 20 and 21 serve as means for sensing the position of the sheet feed unit 10, i.e., they position the feed rollers 10A1 and separating rollers 10B1 at the intermediate between the opposite widthwise edges of the paper sheets, or center, in conformity to a sheet width as sensed by any of the sensors 4, 5 and 6 (see FIG. 4). When the widthwise dimension of the paper sheets is detected in the sheet cassette 2A or 2B in terms of the position of the guide member 3, the sheet width sensor delivers a stop command to the motor 18 on sensing the screening piece 15*c* of the bracket 15. In response, the feed rollers 10A1 and separating rollers 10B1 mounted on the sheet feed unit 10 are brought to a stop at the center of the paper sheets.

Figure 10:
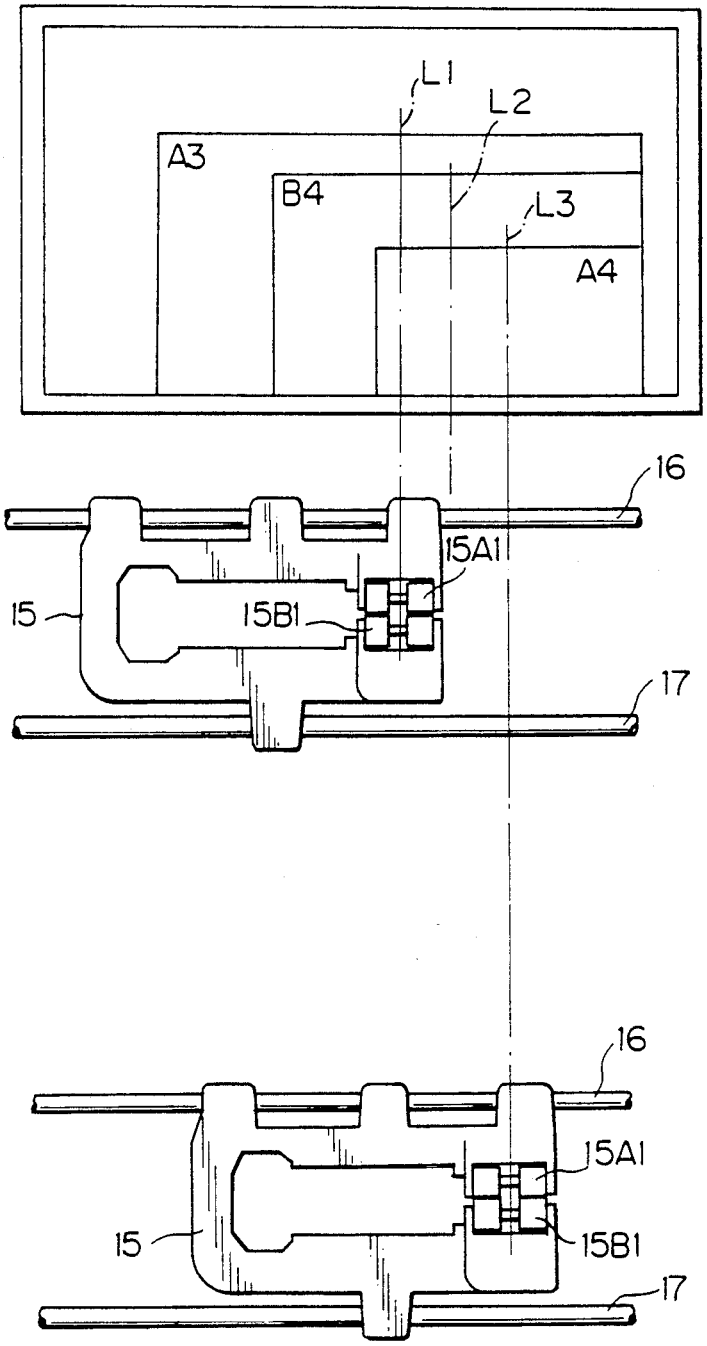
FIG. 10 is a plan view demonstrating the operation of the sheet feed unit shown in FIGS. 7 to 9.

In the structure shown in FIG. 7, in response to a sheet feed command, the motor 18 is driven to start moving the bracket 15 in the widthwise direction of the paper sheets. The motor 18 is deenergized when the bracket 15 reaches a position where the sheet width sensor 19, 20 or 21 associated with the sensor 4, 5 or 6 having sensed the paper size is located. Specifically, as shown in FIG. 10, the feed rollers 10A1 and separating rollers 10B1 are brought to any of particular positions L1, L2 and L3 each being representative of the center of a different sheet size in the widthwise direction. In the illustrative embodiments, let the paper sizes be A3, B4 and A4. The drive structure associated with the feed rollers 10A1 includes a pulley 13 which corresponds to the pulley 13 of FIG. 6. A motor 22 shown in FIG. 7 may be drivably connected to the pulley 13 by a cog belt or similar member, not shown.

Figure 8:
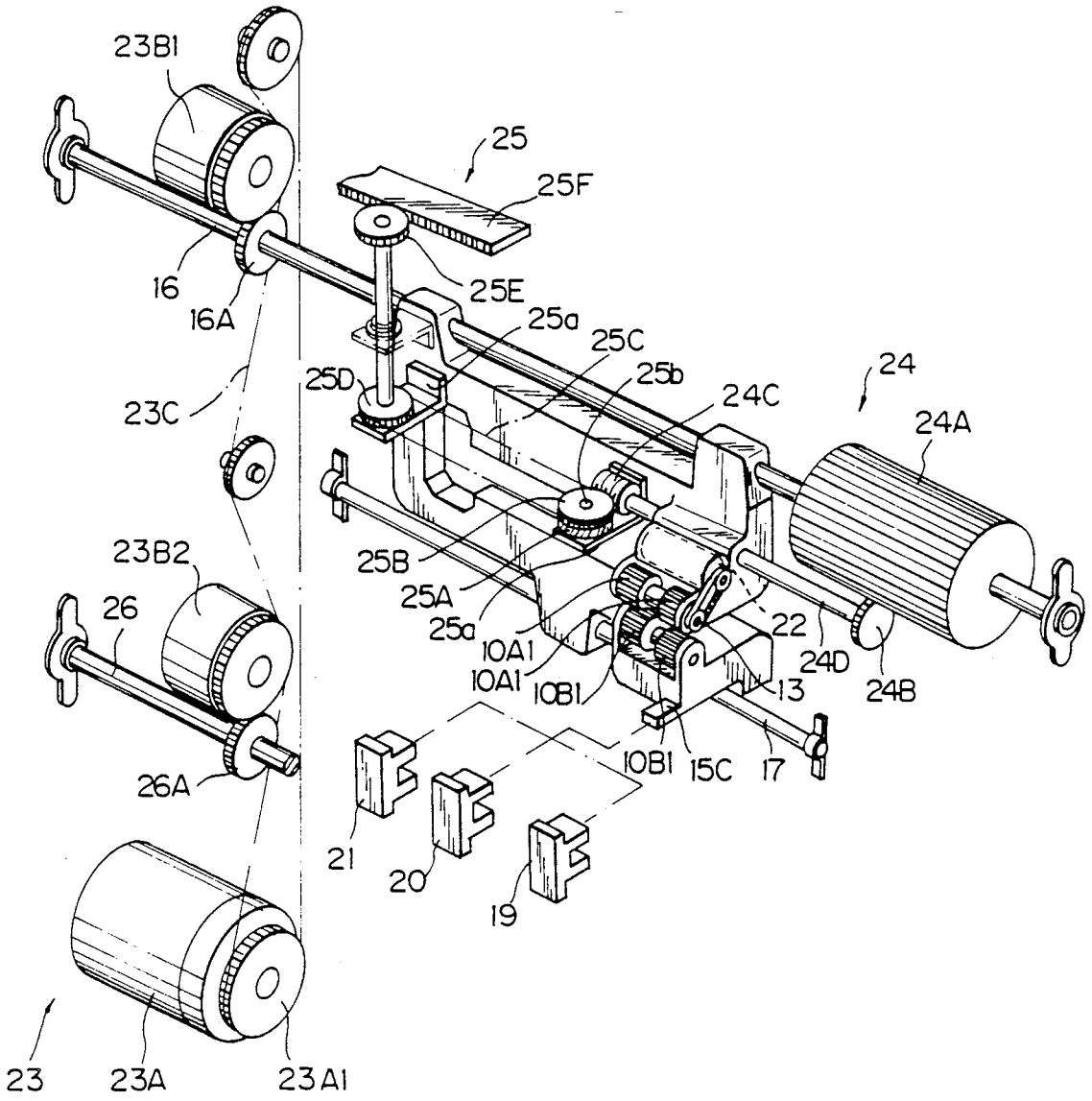
FIGS. 8 and 9 are perspective views each showing a modified form of the drive system of FIG. 7.

FIG. 8 is a view similar to FIG. 7, showing a modified structure for moving the sheet feed unit 10 in the widthwise direction of paper sheets. In FIG. 8, the same components and structural elements as those shown in FIG. 7 are designated by like reference numerals, and redundant description thereof will be omitted for simplicity. The modified structure is characterized in that the arrangement for driving the bracket 15 described with reference to FIG. 7 is shared by the sheet cassettes 2A and 2B for controlling the movement of the individual brackets, and in that the feed rollers 10A1 are driven independently of their associated bracket. Specifically, FIG. 8 shows a drive mechanism associated with the sheet feed unit 10 which is mounted on one of the two sheet cassettes 2A and 2B, as shown in FIG. 2. The drive mechanism is shown as comprising a driving section 23, an interlocking section 24, and a driven section 25.

The driving section 23 has a reversible motor 23A, a cog belt pulley 23A1 mounted on the output shaft of the motor 23A, clutches 23B1 and 23B2, and a cog belt 23C. The clutches 23B1 and 23B2 have gears which are individually held in mesh with gears 16A and 26A which are respectively mounted on the upper shafts 16 and 26 of the sheet cassettes 2A and 2B, and cog belt pulleys which are coaxial with the gears. The cog belt 23C is passed over the cog belt pulleys of the clutches 23B1 and 23B2. The clutches 23B1 and 23B2 are selectively coupled and uncoupled to drive either one of the upper shafts 16 and 26 of the sheet cassettes 2*a* and 2B. The interlocking section 24 comprises a spline gear 24A in place of the threaded portion 16*a*of the shaft 16 shown in FIG. 7, and a rotatable shaft 24D. The shaft 24D carries on one end thereof a gear 24B which meshes with the spline gear 24A and on the other end a worm 24C, and it extends throughout that part of the bracket 15 which supports the feed rollers 10A1. When the spline gear 24A is rotated, the gear 24B and, therefore, the shaft 24D are rotated to in turn drive the worm 24C in a rotary motion. The spline gear 24A will preserve the interlocked relationship even when it moves the portion of the bracket 15 which supports the feed rollers 10A1 in the axial direction. The driven section 25 includes a stub 25*b* studded on a support piece 25*a* which extends out from the bracket 15. A worm gear 25A and a cog belt pulley 15B are coaxially supported by the stub 25*b*. The cog belt pulley 24B is drivably connected to a cog belt pulley 25D by a cog belt 25C. A pinion 25E is supported coaxially with the cog belt pulley 25D. A rack 25F extends out from a stationary part of the sheet cassette in the widthwise direction of paper sheets and is held in mesh with the pinion 25E. The worm gear 25A is meshed with the worm 24C of the interlocking section 24 so that the rotation of the worm 24C is transmitted to the cog belt pulleys 25B and 25D by the worm gear 25A and cog belt 25C. As a result, the pinion 25E coaxial with the cog belt pulley 25D is rotated relative to the ummovable rack 25F to in turn shift the bracket 15 in the widthwise direction of paper sheets. On the other hand, the feed rollers 10A1 are driven by the motor 22 which is mounted on the portion for supporting the feed rollers 10A1, as in the specific construction shown in FIG. 7.

In operation, the clutches 23B1 and 23B2 are selectively coupled and uncoupled to transmit the rotation of the motor 23A to the shaft of either one of the sheet cassettes which is loaded with paper sheets of a desired size. For example, assume that the rotation of the motor 23A is transmitted to the upper sheet cassette 2A shown in FIG. 2. Then, the spline gear 24A mounted on the shaft 16 is rotated to in turn rotate the worm 24C via the gear 24B. The rotation of the worm 24C is transmitted to the pinion 25E via the worm gear 25A. The bracket 15, therefore, is moved in the widthwise direction of the paper sheets until it reaches one of the sheet width sensors 19, 20 and 21 which is responsive to the center of the selected paper size. On reaching such a position, the bracket 15 is brought to a stop with a stop command being fed to the motor 23A.

Figure 9:
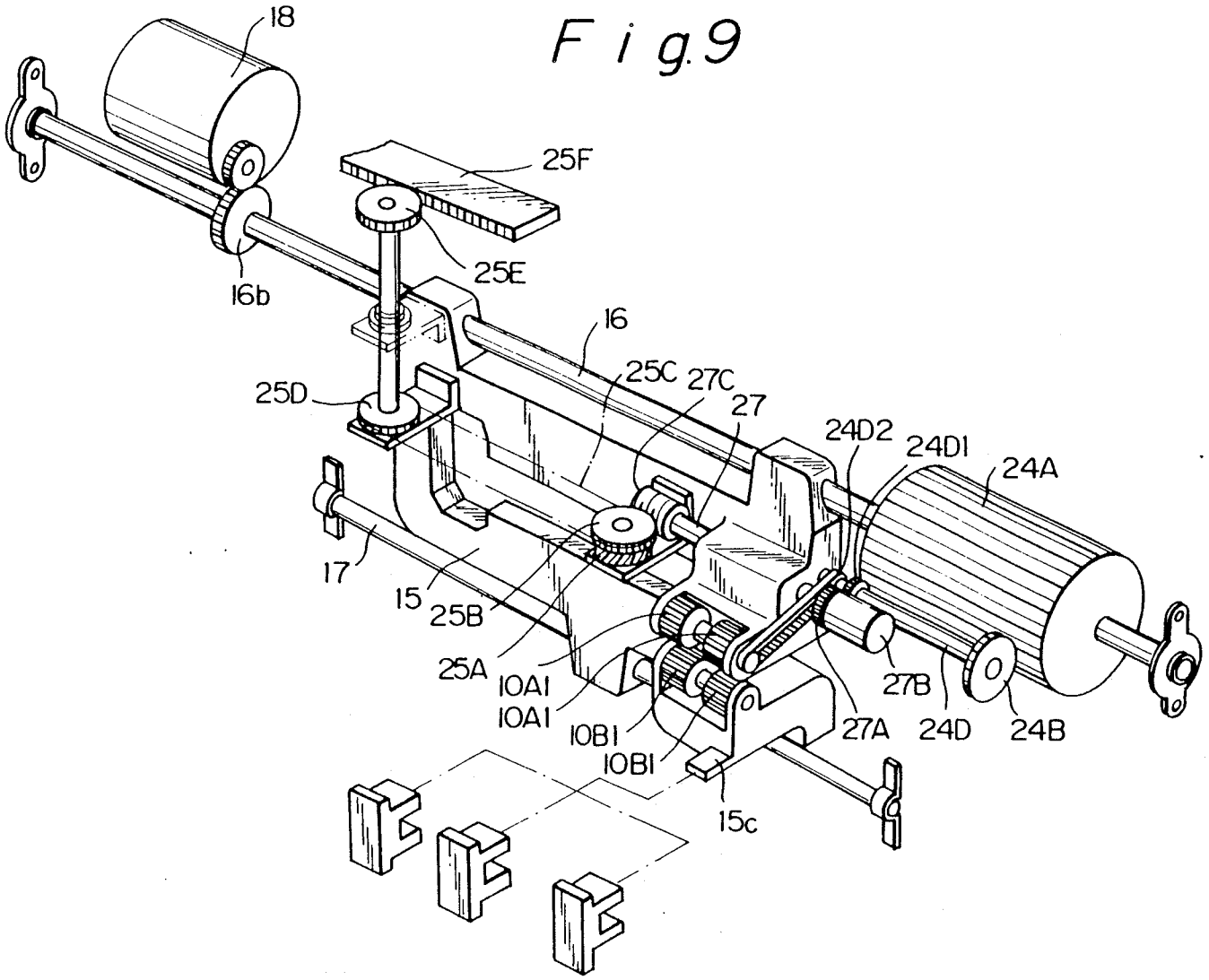

FIG. 9 is a view similar to FIG. 8, showing another modified form of the drive mechanism associated with the sheet feed unit. The mechanism of FIG. 9 implements the drive of the bracket 15 and that of the feed rollers 10A1 by a single drive source. Specifically, the shaft 24D, carrying the gear 24B at one end thereof, is rotatably supported by the bracket 15 adjacent to the feed rollers 10A1, the gear 24B meshing with the spline gear 24A. A gear 24D1 and a pulley 24D2 are integrally mounted on the base end of the shaft 24D. The shaft 16 shown in FIG. 9 is driven in a rotary motion by the combination of the gear 16*b* and motor 18, as with the shaft 16 of FIG. 7. A shaft 27 extends throughout and is rotatably supported by the bracket 15 adjacent to the feed rollers 10A1, as illustrated. The shaft 27 is parallel to the shaft 24D and carries a gear 27A at one end thereof adjacent to the spline gear 24A. A clutch 27B is provided integrally with the gear 27A on the shaft 27. A worm 27C similar to the worm 24C of FIG. 8 is rigidly mounted on the other end of the shaft 27. The worm gear 25B shown in FIG. 8 is held in mesh with the worm 27C to constitute the driven section 25.

In the structure described above with reference to FIG. 9, the rotation of the motor 18 is constantly transmitted to the spline gear 24A. Then, the spline gear 24A not only drives the feed rollers 10A1 via the gears 24B and 24D1 but also moves the bracket 15 via the gear 27A on the shaft 27 which is controlled by the clutch 27B and the worm 27C on the shaft 27.

Figure 11:
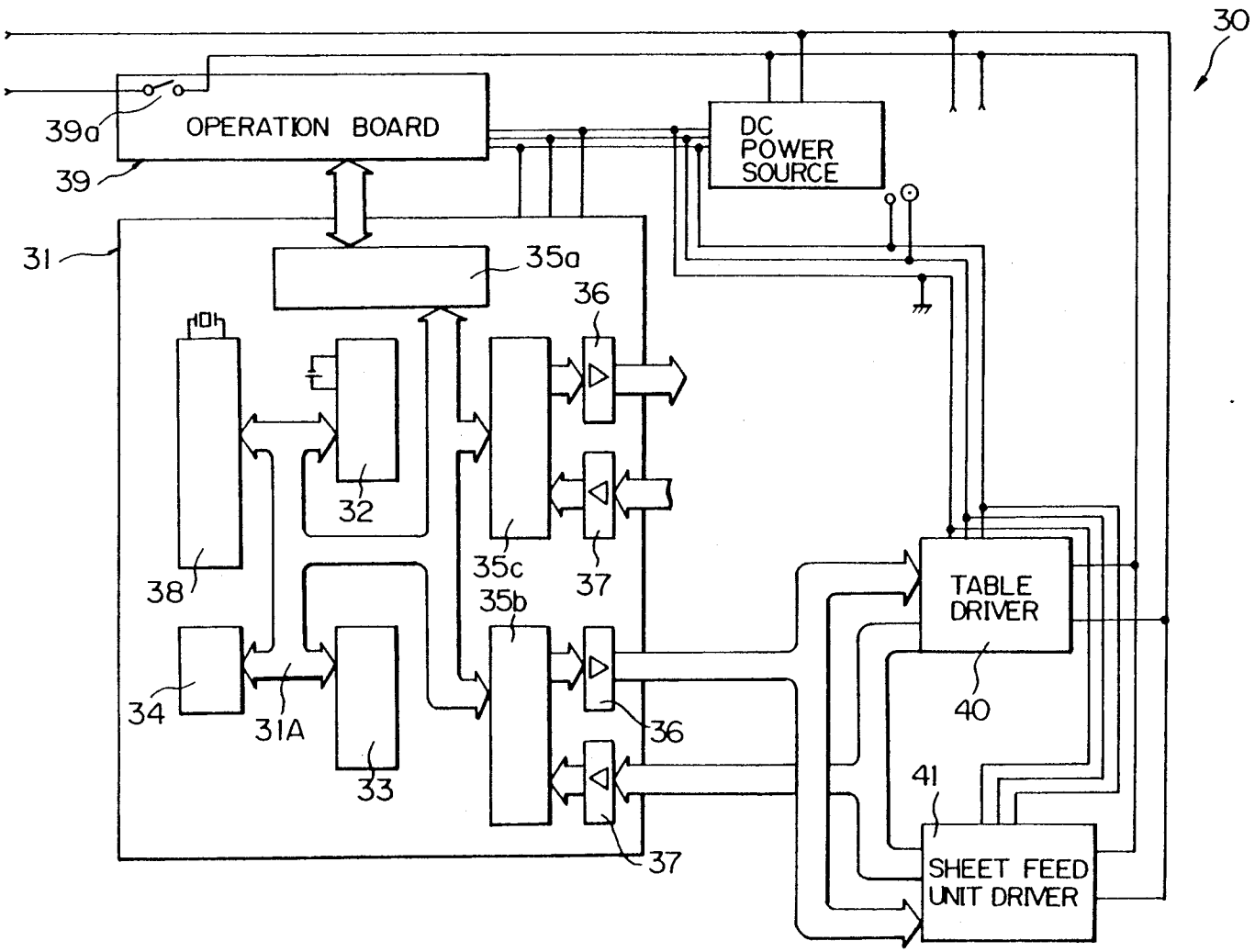
FIG. 11 is a schematic block diagram showing control circuitry associated with the drive system of FIG. 9.
Figure 12:
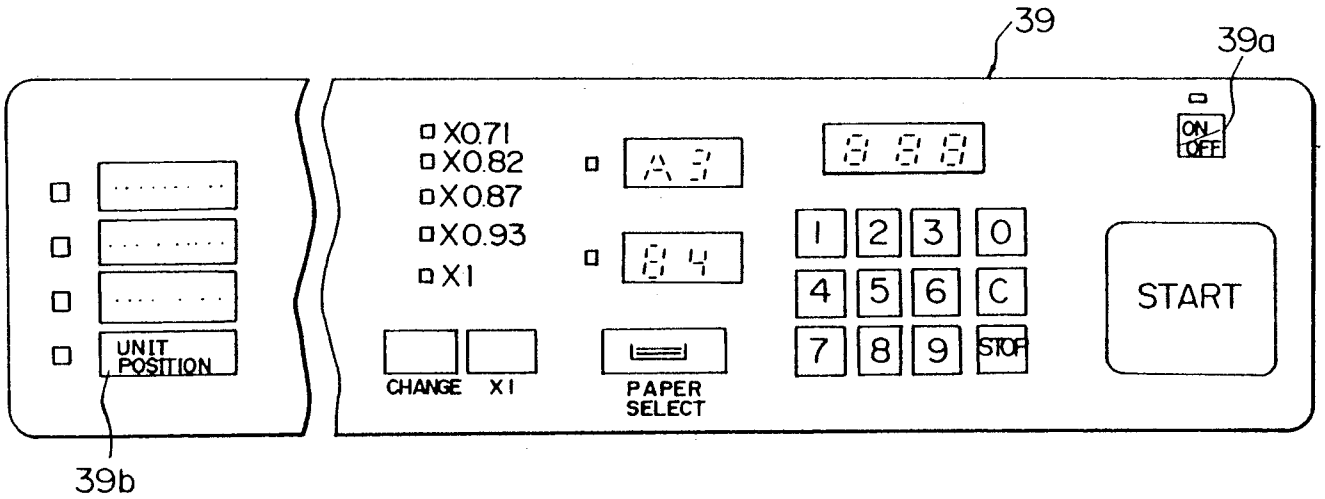
FIG. 12 is a plan view of an operation board.

Referring to FIG. 11, control circuitry for the controllable drive of the sheet feed unit 10 is shown. As shown, the circuitry, generally 30, includes a main control board 31 for controlling the entire system assigned to sheet feed control. Loaded on the main conrol board 31 are a RAM 32 backed up by a battery for storing control data, a ROM 33 loaded with control programs, timers 34 representative of a plurality of timers and counters, input/output (I/O) interfaces 35*a*, 35*b* and 35*c*, output driver arrays 36, input buffer arrays 37, and micrcomputers (hereinafter referred to as CPUs) 38 for controlling such various components. The components provided on the main control board 31 are interconnected by a bus line 31A. An operation board 39 has a power switch 39*a* and is connected to the CPU 38 via the I/O interface 35*a*. A specific arrangement of the operation board 39 is shown in FIG. 12. A driving section 40 for moving the tables 2A1 and 2B1 of the sheet feeder 2 up and down and a driving section 41 for moving the sheet feed unit 10 are connected to the I/O interface 35*b*.

Figure 13A:
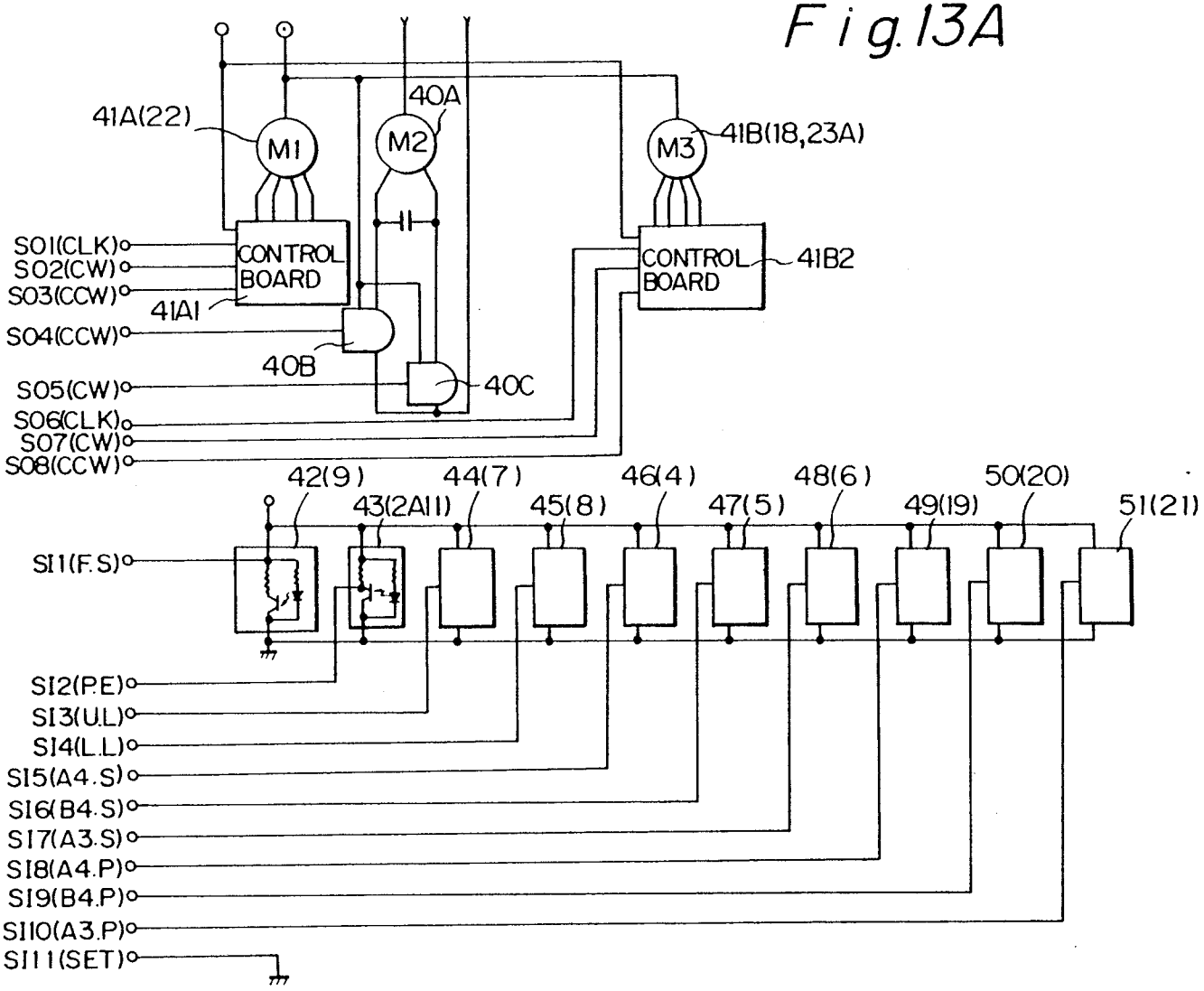
FIGS. 13A and 13B are schematic block diagrams useful for understanding an essential part of FIG. 11.
Figure 13B:
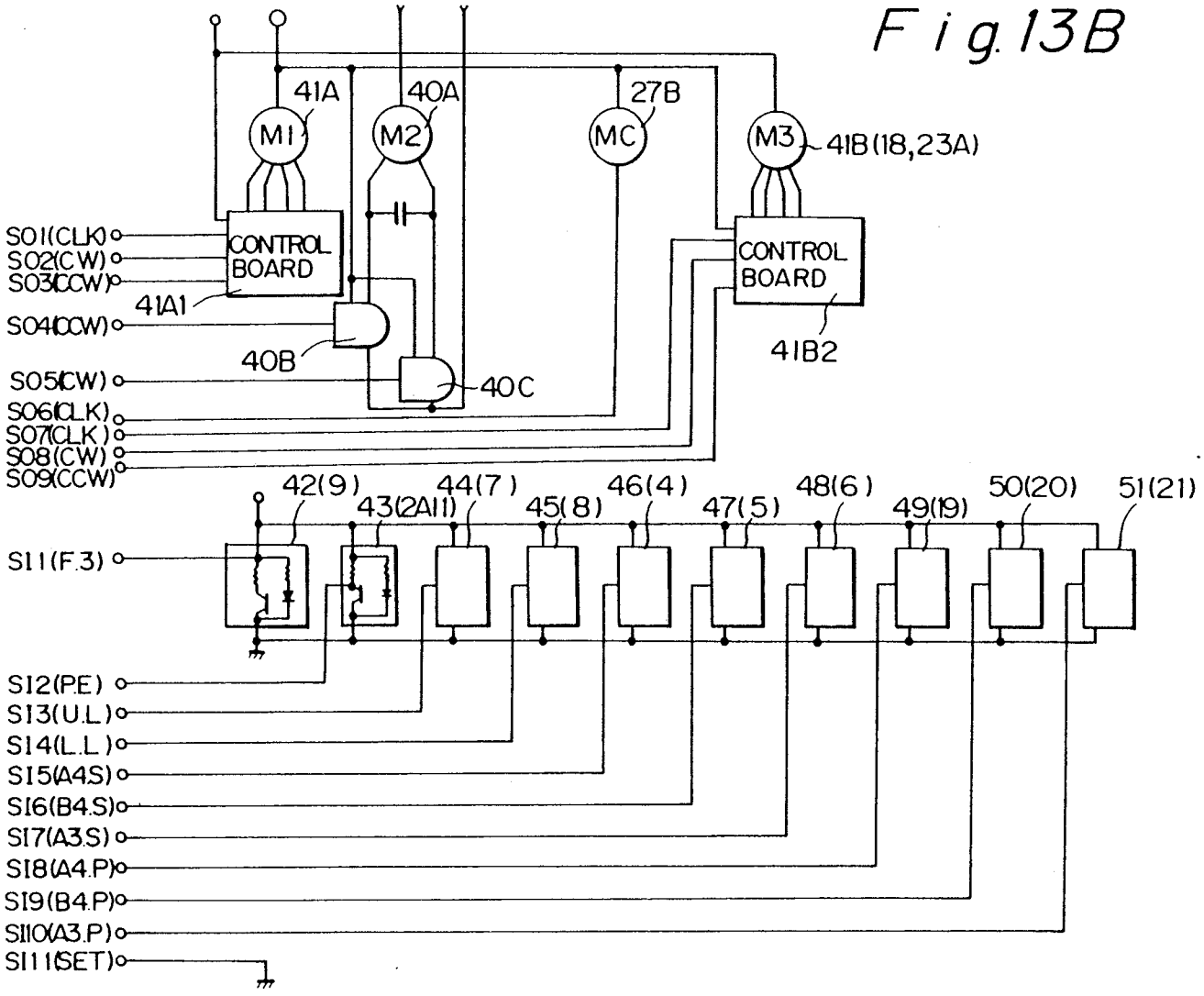

Referring to FIGS. 13A and 13B, specific constructions of the driving sections 40 and 41 mentioned above will be described. FIG. 13A is associated with FIGS. 7 and 8 in which the feed rollers 10A1 of the sheet feed unit 10 are driven by the motor 22, while FIG. 13B is associated with FIG. 9 in which the sheet feed unit 10 is moved by the clutch 27B. In FIG. 13A, a motor 40A is representative of an AC reversible induction motor for implementing the driving section 40, and its rotating direction is determined by signals S04 and S05 which are fed from solid state relays 40B and 40C, respectively. In the construction shown in FIG. 13A, when the motor 40A is rotated clockwise (CW), the table 2A1 or 2B1 (see FIGS. 2 and 3) is elevated; when the former is rotated counterclockwise (CCW), the latter is lowered. A stepping motor 41A corresponds to the motor 22 which is adapted to drive the feed rollers 10A1 as previously stated. The rotating direction of the stepping motor 41A is determined by a signal which is fed to a control board 41A1 having a motor driver thereon. A position command S01 sets up an amount of rotation which is associated with an amount of feed. Then, a forward signal S02 corresponding to the clockwise (CW) direction rotates the feed rollers 10A1 in the direction for feeding a paper sheet, while a reverse signal S03 corresponding to the counterclockwise direction (CCW) causes rotation in the opposite direction to the intended direction of paper feed. Further, a stepping motor 41B corresponds to either one of motor 18 of FIG. 7 or motor 23A of FIG. 8, which are adapted to move the sheet feed unit 10. The rotating direction of the stepping motor 41B is determined by a signal which is fed to a control board 41B1 having a motor driver thereon. In the specific construction of FIG. 13A, a position command S06 determines an amount of rotation of the motor 41B, a forward signal S07 associated with the clockwise direction moves the sheet feed unit 10 to select a greater sheet width as shown in FIG. 10, and a reverse signal S08 associated with the counterclockwise direction moves it to select a smaller sheet width.

Also shown in FIG. 13A are various sensors 42 to 51. The sensor 42 is the sheet feed sensor 9 shown in FIG. 5 and is implemented as a reflection type photosensor. The sensor 9 serves to prevent the trailing edge of a paper sheet from being delayed at the time of sheet feed, as stated previously. The sensor 43 is the paper end sensor 2A11 of FIG. 3 which is implemented as an interception type photosensor. The sensors 44 and 45 are respectively the upper limit sensor 7 and the lower limit sensor 8 which are shown in FIGS. 3, 5 and 6, and each is constituted by an interception type photosensor. The sensors 46 to 48 are interception type photosensors implementing the position sensors 4, 5 and 6, respectively. The position sensors 4, 5 and 6 are responsive to the position of the guide member 3 shown in FIG. 4 and, therefore, to the width of paper sheets stacked on the table 2A1 (A4, A3 and B3 in the illustrative embodiment). Further, the sensors 49 to 51 are the sheet width sensors 19, 20 and 21 responsive to the position of the sheet feed unit 10 shown in FIGS. 7 to 9 (center of each of sizes A4, A3 and B4 in the illustrative embodiment) and each being implemented as an interception type photosensor.

In FIG. 13B, the clutch 27B is shown in addition to the motor 22 which drives the feed rollers 10A1 of FIG. 9. The position command signal S06 shown in FIG. 13A is used as an ON time setting signal for maintaining the clutch 27B in a coupled state. When the clutch 27B is coupled by the signal S06 and only if the motor 18 shown in FIG. 9 is rotating forward, the feed rollers 10A1 will be rotated in the direction for feeding out a paper sheet.

In FIGS. 13A and 13B, the sensors are individually activated when their optical paths are intercepted and, at that time, show that the individual expected statuses have been reached.

The operation of the illustrative embodiment will be described with reference to FIG. 14A and successive figures. It to be noted that the tables shown in FIG. 2 are hereinafter referred to as trays for the sake of convenience.

Figure 14A:
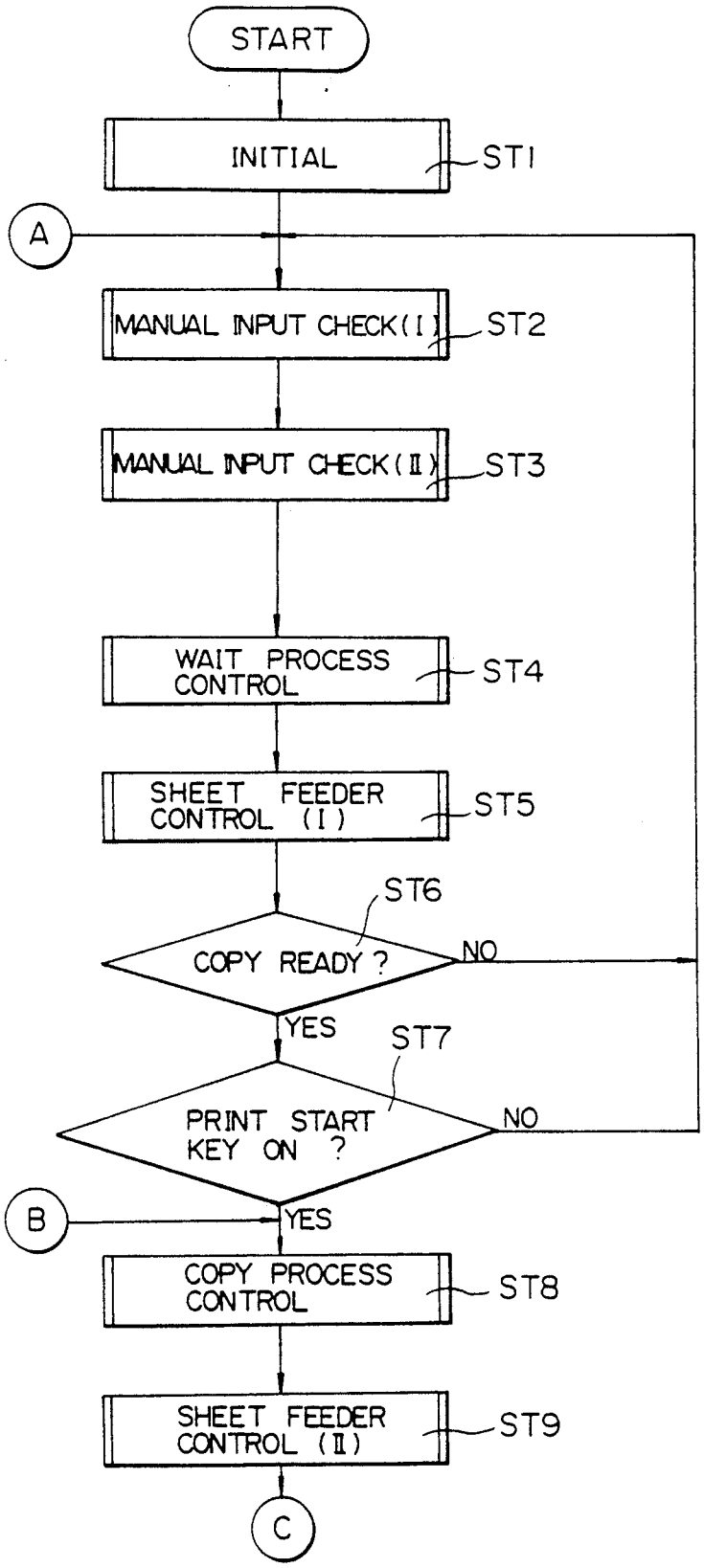
Figure 14B:
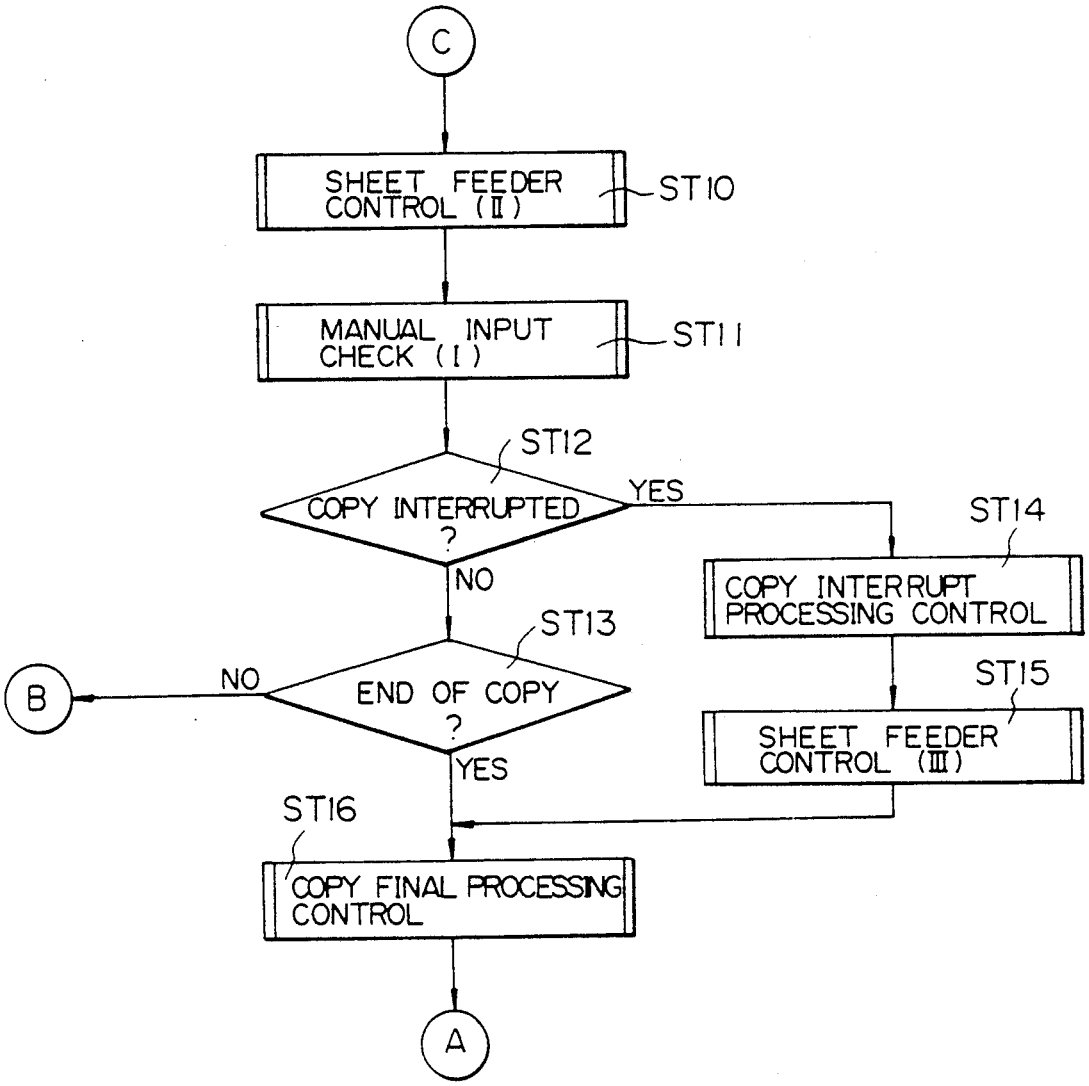

FIGS. 14A and 14B show a main routine associated with sheet feed control. When the switch 39*a* of the operation board 39 shown in FIG. 12 is turned on, a drive current is fed to the main control board 31 which then starts on the control programs which are stored in the ROM 33. The main routine begins with diagnosis processing associated with the supervision of the entire copier 1 including sheet feed control (ST1). This is followed by manual input check (I) processing for checking key inputs on the operation board 39, manual input check (II) processing for checking key inputs representative of sheet feed conditions and other various conditions, and sheet feeder control (I) processing for effecting various preparatory operations necessary for the copier wait process control and sheet feed unit shift control (ST2 to ST5). These subroutines ST2 to ST5 will be described in detail later. On completion of the subroutine ST5, whether or not the copier 1 is ready is determined (ST6). If the answer of the step ST5 is NO, the program returns to the step ST2. If the answer of the step ST5 is YES, whether or not a copy start command has been produced is determined (ST 7). If the answer of the step ST7 is NO, the program again returns to the step ST2; if otherwise, copy process control processing (ST8) is executed by the copier 1 so as to form an image. Timed to the image forming operation, sheet feeder control (I) processing is executed (ST9) in order to feed a paper sheet on the basis of the previously mentioned preparatory operations.

Subsequently, sheet feeder control (II) processing is executed to feed only one paper sheet within the sheet feeder 2 (ST10). The step ST10 is followed by another manual input check (I) processing (ST11) to see the copying conditions associated with the feed of a paper sheet. For example, whether a copying operation has been interrupted by the operation of a stop key provided on the operation 39 or by a jam is determined (ST12), and then whether or not the copying operation has been ended is determined (ST13). When the copying operation has been interrupted as decided in the step ST12, there is executed a copy interrupt processing control for interrupting the execution of a copying operation and sheet feeder control (III) for controlling the movement of the sheet feed unit 10 (ST14 and ST15). If the copying operation has not been ended as determined in the step ST13, the step ST8 and successive steps are repeated; as soon as it is ended, final copy process control is executed. This is followed by a step ST2 for causing the copier into a standby mode.

Figure 15A:
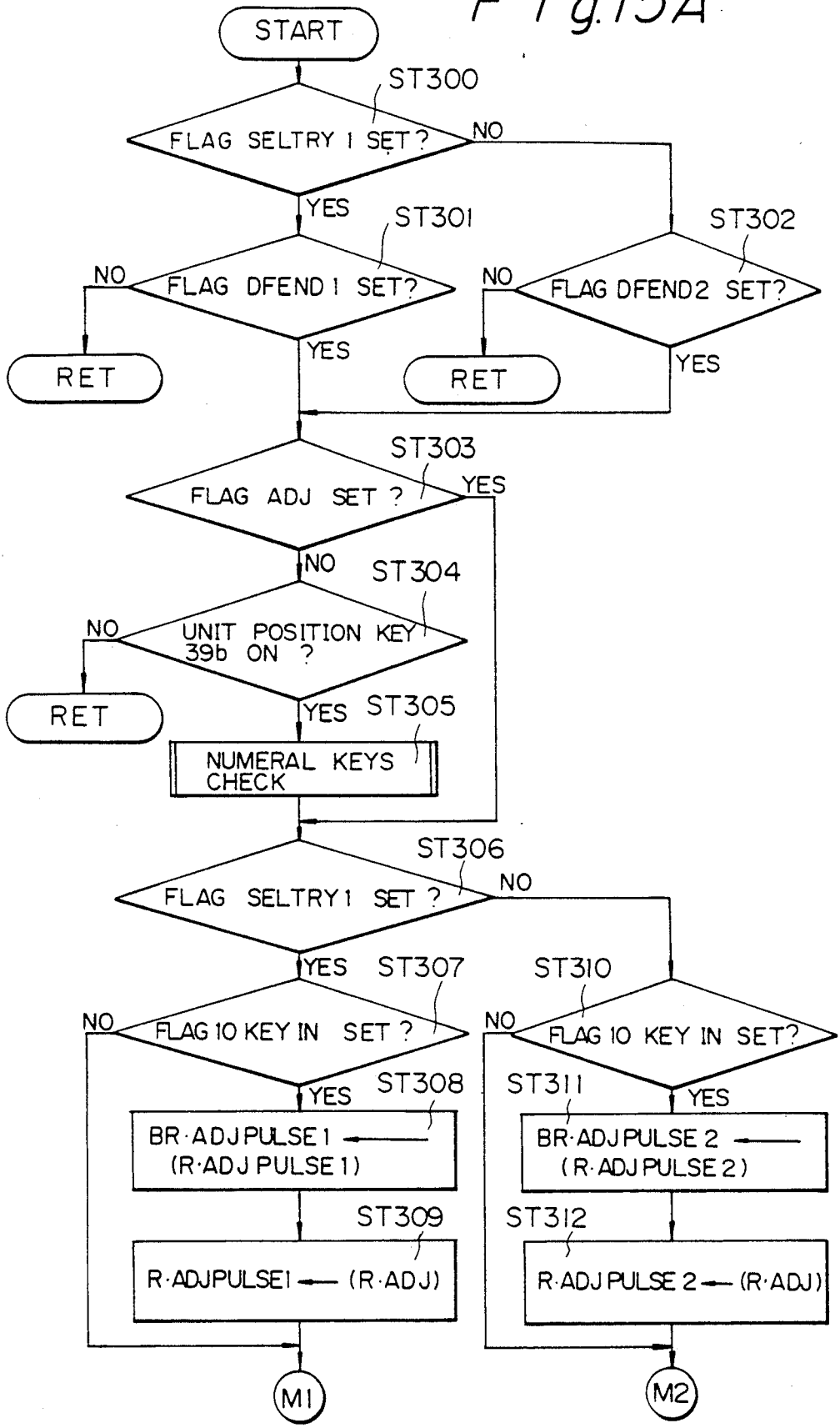
Figure 15B:
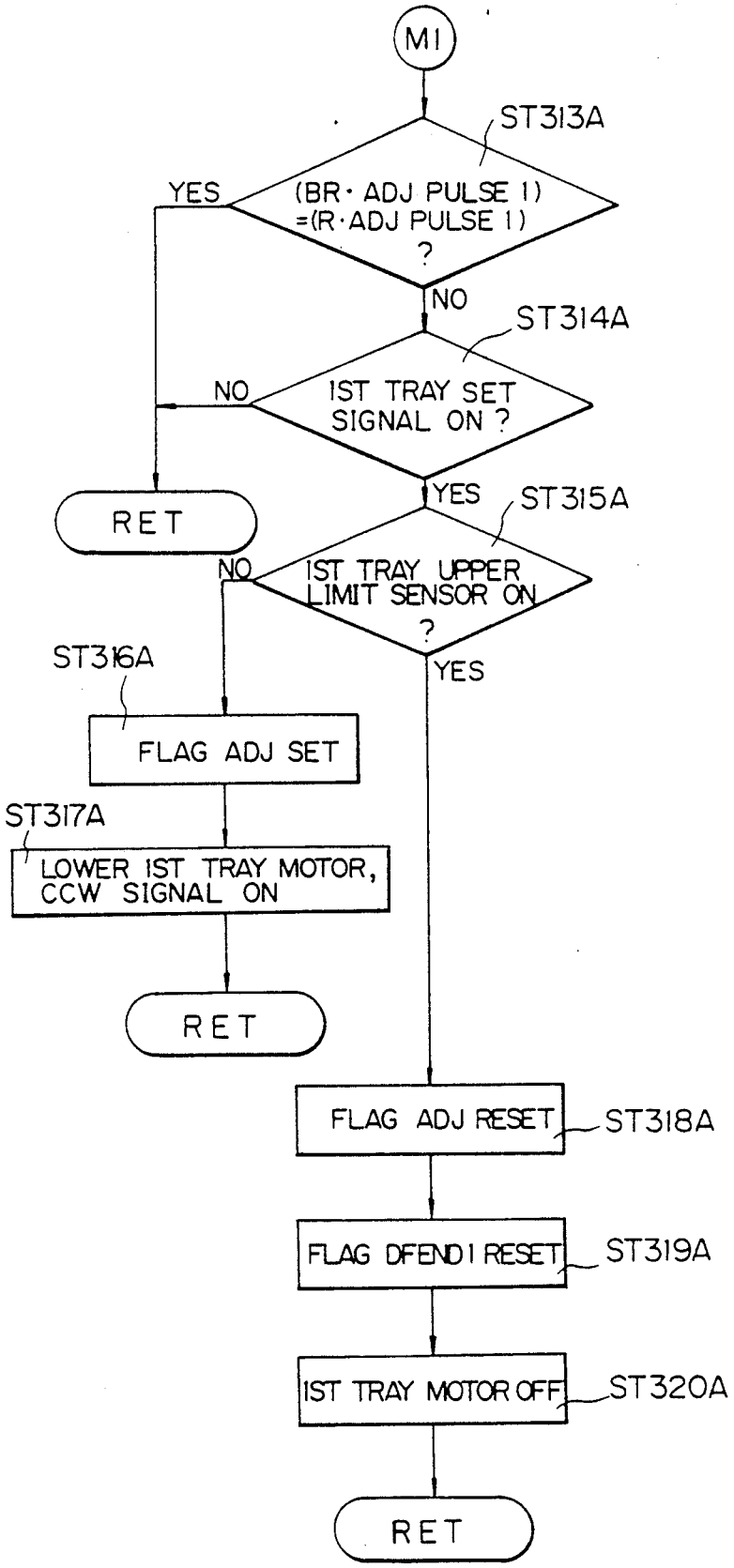
Figure 15C:
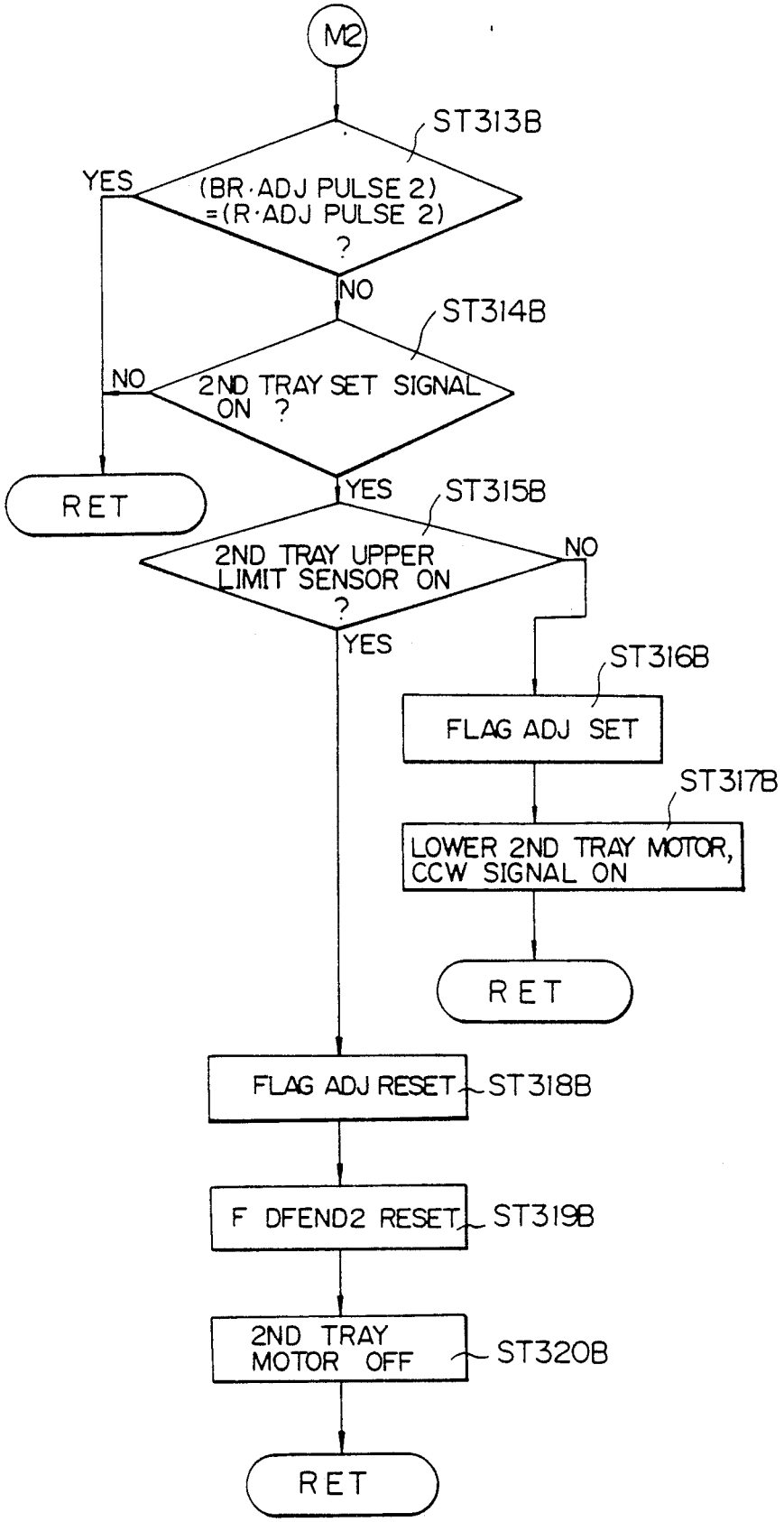

Referring to FIG. 15A, the manual input check routine (II) is shown in detail. This subroutine constitutes a preparatory stage which precedes the movment of the sheet feed unit 10, i.e., for moving the screening piece 10A4 provided on the pull-out roller 10A2 support portion of the sheet feed unit 10 away from the upper limit sensor 7 of the sheet cassette. Specifically, whether or not a flag SELTRY representative of the selection of a sheet cassette is set is determined (ST300). Assuming that a flag SELTRY1 is set indicating that the upper sheet cassette 2A shown in FIG. 2 has been selected, then whether or not that sheet cassette has actually been loaded in the copier 1 is determined by referencing the output of a cassette sensor, not shown, (ST301). This decision also occurs when the answer NO of the step ST300 is interpreted to mean that the lower sheet cassette 2B is selected (ST302). When any of the sheet cassettes is selected as decided in the step ST301 or ST302, a flag ADJ is checked to see if data for adjusting the position of the sheet feed unit 10 have been set (ST303). If the answer of the step ST303 is NO, whether data have been entered on a sheet feed unit position key 39*b* of the operation board 39 (see FIG. 12) is determined; if it is YES, numeral key check processing is executed (ST305). Setting entered on the sheet feed unit position key 39*b* is valid on condition that the desired sheet cassette 2A or 2B is available in the copier 1, that the sheet feed unit 10 undergone movement once within that sheet cassette is to be driven again for feeding paper sheets of an alternative size, and that the flag ADJ is reset, and to a time immediately before the pull-out rollers 10A2 of the sheet feed unit 10 is lowered to a position where the screening piece 10A4 (see FIG. 5) is brought out of alignment with the upper limit sensor 7. This requires that data associated with a shift of the sheet feed unit 10 be entered before the start of the shift.

After the numeral key check (ST305), whether or not a value for adjustment entered on the numeral keys is meant for a first table, i.e., the table 2A1 of the upper cassette 2A shown in FIG. 2, is determined (ST306). If the answer of the step ST306 is YES, the program advances to a step ST307 and successive steps; if otherwise, the program executes a step ST310 and following steps. The steps ST307 to ST309 and the steps ST310 to ST312 are identical with each other except for the kind of a sheet cassette selected. Specifically, when data is entered on the numeral keys, data stored in a non-volatile memory area R. ADJPULSE1 or R. ADJPULSE2 of the RAM 32 is saved in a memory area BR. ADJPULSE1 or BR. ADJPULSE 2 so as to store the data entered on the numeral keys in the memory area R. ADJPULSE1 or R. ADJPULSE 2. Then, the table (2A1 or 2B1) of the sheet cassette (2A or 2B) begins to be lowered only if two different conditions are satisfied, i.e., that the data entered on the ten keys is different from the current data and that a table set signal is in an ON state.

Therefore, in the program, whether or not the above-mentioned two conditions are satisfied is determined (ST313A and ST313B), and if the upper limit sensor 7 in the sheet cassette has been activated, i.e., if the pull-out rollers 10A4 have been urged upward by the table 2A1 or 2B1, is determined (ST314A or ST314B). An arrangement is made such that the table 2A1 or 2B1 is lowered before the upper limit sensor 7 turns to an OFF state. If the upper limit sensor 7 is in an ON state as stated above, a flag for lowering the table is set so as to rotate a motor associated with the table in a direction for lowering the table, i.e., counterclockwise in the illustrative embodiment (ST314A and ST317A or ST316B and ST317B). As soon as the upper limit sensors 7 turns from an ON state to an OFF state, the flags associated with the downward movement of the table are reset to stop the rotation of the exclusive motor (ST318A to 320A or ST318B to 320B). As a result, the screening piece 10A4 (see FIGS. 5 and 6) is brought out of the position where it interferes with the upper limit sensor 7, allowing the sheet feed unit 10 to be moved.

Figure 16:
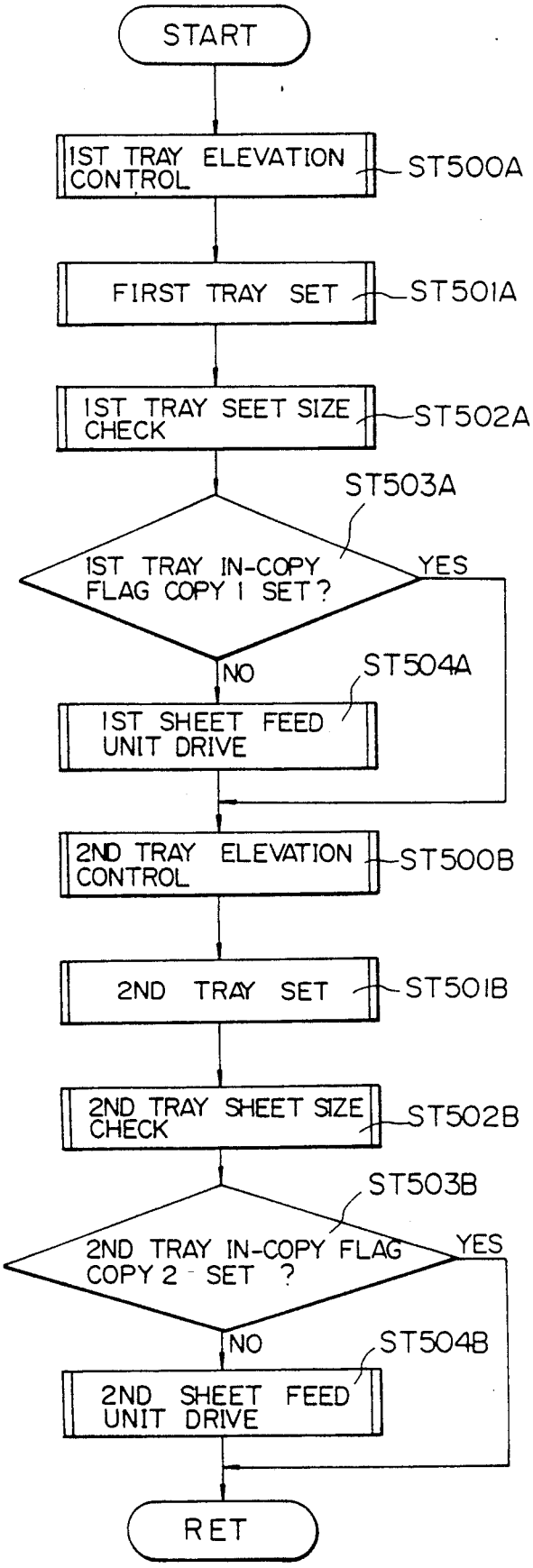

Referring to FIG. 16, the sheet feeder control (I) included in the main routine is shown specifically. This subroutine executes various kinds of processing associated with the drive of the sheet feeder 2, i.e., control over the elevation of the table, confirmation as to the presence of a desired cassette, detection of a paper size on the table on the basis of the correspondence of the guide member 3 and the size sensors 4, 5 and 6 within the cassette, decision as to the presence of paper sheets, and control over the drive of the sheet feed unit 10 (ST500A to ST504A or ST500B to ST504B). Among these steps, the step 503A or 503B executes a decision for inhibiting the drive of the sheet feed unit 10 while a copying operation is under way.

Figure 17:
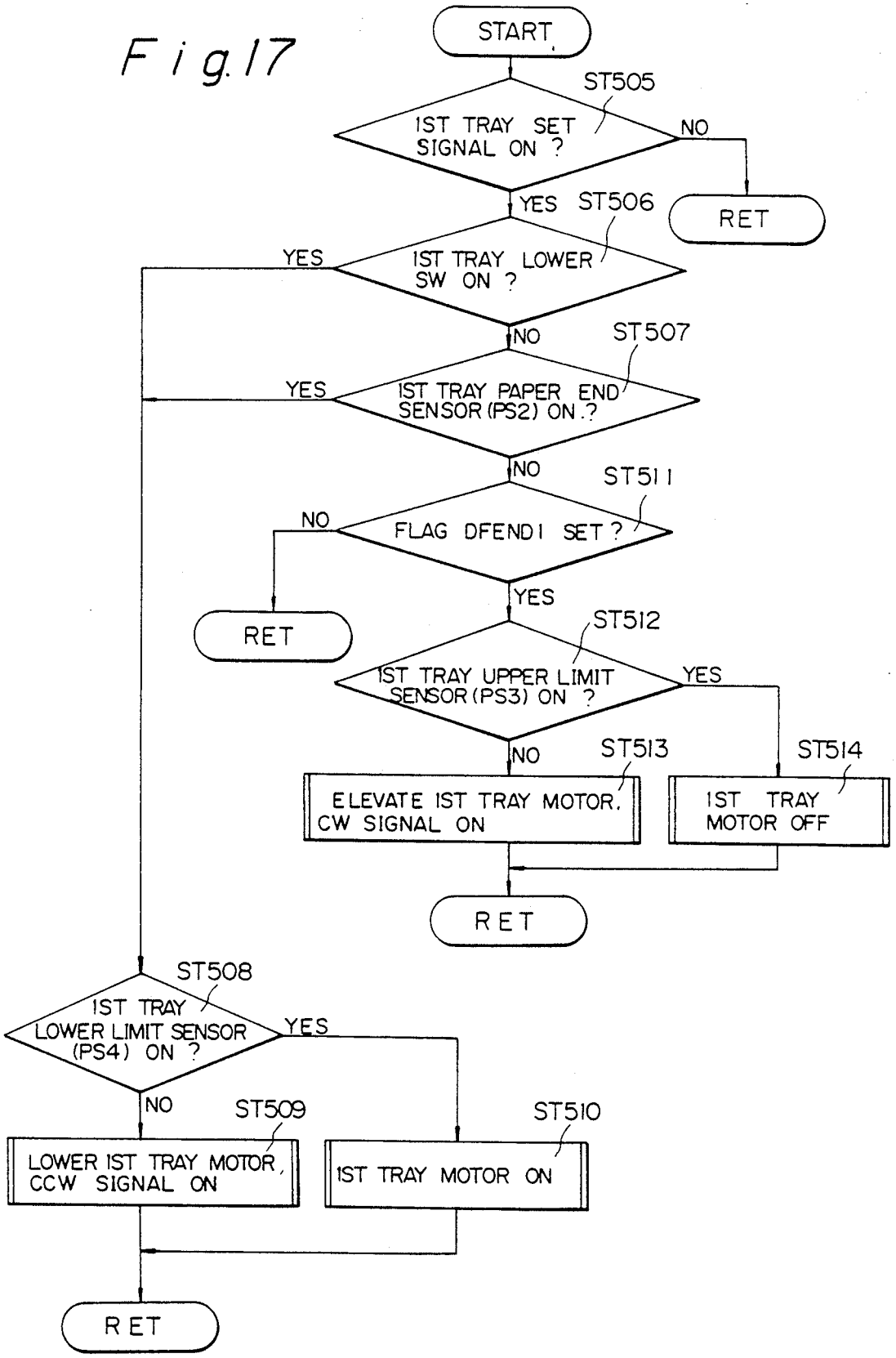

FIG. 17 demonstrates a procedure which will be executed when a state wherein the paper stack on the table fails to contact the pull-out rollers 10A2 of the sheet feed unit 10 is reached. Specifically, whether or not a tray set signal indicating that sheet feed is from the table of a selected cassette is in an ON state is determined (ST505). Whether or not the operator has manipulated a table lowering switch, not shown, is determined, and also whether or not the paper end sensor 8 on the table has been activated is determined (ST506 and ST507). If the answer of the step ST506 or ST507 is YES, whether the table has been lowered to the lower limit is determined (ST508); if the answer is NO, the motor associated with the table is turned on to lower the table while, if it is YES, the motor (tray motor in the figure) is turned off (ST509 and ST510). Such drive of the table motor is switched over in direction after the table lowering switch has been turned off by the operator, the paper end sensor 8 has been activated, and a flag DFEND has been set. In this condition, the table is switched from downward movement to upward movement and then stopped on the turn-on of the upper limit sensor 7. When the table should not be lowered as decided in the step ST507, whether the table is in a position for allowing a paper sheet to be fed in association with the pull-out rollers 10A2 is determined by referencing the state of the upper limit sensor (ST512). If the answer of the step S512 is NO, the table motor is rotated in the direction for elevating the table (ST513); if otherwise, the table motor is turned off (ST514). By such a procedure, the table is constantly held in a position which urges the paper sheets against the pull-out rollers 10A2 of the sheet feed unit 10, thereby insuring the feed of paper sheets. When the table has run out of paper sheets, it is moved to a position to supply paper sheets.

Figure 18:
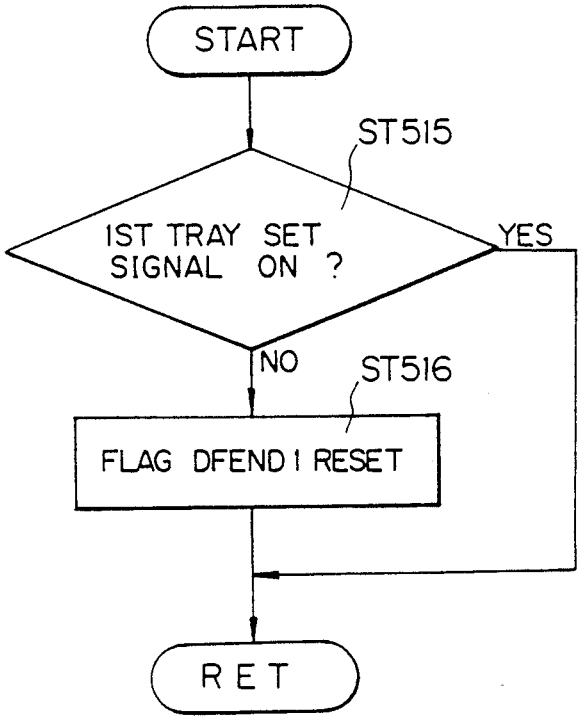

FIG. 18 shows a routine for determining whether or not the sheet cassette is loaded in the copier, a condition on which the table is movable. As shown, whether or not a cassette set sensor, not shown, installed in the sheet feeder 2 is in an ON state is determined (ST515). If the answer of the step ST515 is NO, meaning that the sheet cassette is absent, a flag DFEND is reset (ST516).

Referring to FIGS. 19A to 19F, the step ST9 of the main routine, i.e., sheet feeder control (I) will be described. By this routine, the sheet feed unit 10 is moved such that the feed rollers 10A1 and separating rollers 10B1 are located at the center of paper sheets in the widthwise direction of the latter. The following description will concentrate on paper sheets stacked on the table 2A1 (represented by the first tray in the figures) of the upper sheet cassette 2A by way of example.

The sheet feeder control (I) procedure begins with a step ST900 for determining that the flag DFEND shown in FIG. 15A is reset, i.e., the processing for moving the sheet feed unit 10 has not begun. Specifically, this procedure occurs on condition that the main switch of the copier 1 has been turned on, the sheet cassette has been pulled out, and new data for adjustment has been entered on the sheet feed unit position key 39 (see FIG. 12). If the answer of the step ST900 is NO, position sensor check processing (ST901) is executed for sensing the current position of the sheet feed unit 10. Specifically, with which of the sheet width sensors 19, 20 and 21 (see FIGS. 7 to 9) the sheet feed unit 10 is aligned is determined, and the result of the determination is stored in a non-volatile memory area R. POSI1 shown in FIG. 11. If none of those sheet width sensors produces an output, "0" is written in the non-volatile memory area R. POSI1.

In the illustrative embodiment, when none of the sheet width sensors produces an output, it is determined that the sheet feed unit 20 is not aligned with any of the sensors 19, 20 and 21 and is located between the sensors. Specifically, when no sheet width sensor produces an output as decided in the step ST902, processing for moving the sheet feed unit 10 to a position where it corresponds to the sheet feed unit 10 is executed as will be described in detail later. On completing this processing, the program sets a flag INITIAL and identifies the content of the flag (ST902). If the processing for bringing the sheet feed unit into alignment with any of the sheet width sensors has been completed as decided in the step ST902, processing for moving the sheet feed unit 10 to the center of paper sheets in the widthwise direction is executed. For the movement of the sheet feed unit 10, three different modes are available. In FIGS. 19B to 9D showing the three different modes, the steps which are essentially similar to each other are indicated by changing the suffixes.

A first mode occurs when the position of the sheet feed unit 10 which is in a halt is identical with the target size as decided on the basis of the selected sheet size. Then, the current position of the sheet feed unit 10 is compared with the sheet size stored in the RAM 32 (ST903), and the sheet feed unit 10 is moved to a position associated with a larger one of the sheet sizes until the sheet width sensor being in an ON state turns to an OFF state. Specifically, the program rotates the motor 18 or 23A (see FIGS. 7 to 9) counterclockwise so as to move the sheet feed unit 10 in the above-stated direction (ST903A). In the illustrative embodiment, an expedient is provided against an occurrence that the sheet feed unit 10 does not move despite a drive command being fed to the motor 18 or 23A. A step ST904A is representative of such an expedient, i.e., it determines whether or not the movement of the sheet feed unit 10 has been completed within a certain desired period of time. Specifically, when a certain period of time expires before the start of movement of the sheet feed unit 10, the program clears all the flags associated with the movement of the unit 10 and turns off the motor to stop the movement of the sheet feed unit 10 (ST905A to ST909A). On the other hand, when the sheet feed unit 10 begins its movement within a certain period of time, with which of the sheet width sensors 19, 20 and 21 the unit 10 has been aligned is determined (ST910A). If it has been aligned with none of the sensos 19, 20 and 21, the steps described so far are repeated until alignment occurs. If the sheet feed unit 10 has been aligned with any of the sensors 19, 20 and 21, the motor drive pulses and the certain period of time is cancelled to stop the rotation of the motor and thereby the sheet feed unit 10 (ST911A to ST913A).

A second mode associated with the movement of the sheet feed unit 10 occurs when the current position where the sheet feed unit 10 which is in a halt is short of the target position as obtained from the selected sheet size. This mode, like the first mode, begins with a step ST904B for determining whether or not the sheet feed unit 10 has started moving. This is followed by a step ST904 for checking a flag THPOS1 which is to be set when the sheet feed unit 10 is aligned with any of the sheet width sensors. If this flag THPOS1 is set, whether or not the sheet feed sensor is actually in an OFF state is determined (ST914A), the sheet feed unit drive motor is deenergized, the certain time for determining whether of not the sheet feed unit 10 has started moving is cancelled, and a counter responsive to motor drive pulses is reset (ST914B to ST914D). When the movement of the sheet feed unit 10 has occurred within a predetermined period of time (desired period of time) as decided in the step ST904B, a flag for indicating it is set, the counter is reset for a certain period of time, and an initial flag for returning the sheet feed unit 10 to a predetermined position is reset (ST905B to ST907B). Thereupon, the flag THPOS1 indicating the alignment of the sheet feed unit 10 with any of the sheet width sensors is reset (ST915), and the counter responsive to the motor drive pulses is reset (ST908B). When the sheet feed unit 10 is not aligned with any of the sheet width sensors as decided in the step ST914, it is continuously moved until it aligns with any of the sensors. As soon as the unit 10 aligns with any of the sensors, the flag THPOS1 is set (ST910B and ST916).

A third mode associated with the movement of the sheet feed unit 10 occurs when, contrary to the second mode, the current position where the unit 10 which is in a halt is in excess of the target position as obtained from the selected sheet size. In the third mode, the sheet feed unit drive motor is driven clockwise so as to move the sheet feed unit 10 toward the minimum sheet size position (STP917). Whether or not this movement of the unit 10 occurs within a predetermined (desired) period of time and whether the unit 10 has aligned with any of the sheet width sensors are determined (ST904C and ST910C). Based on the results of these decisions, processing ST905A to ST909A shown in FIG. 19B and processing corresponding to steps ST914A to ST914C are executed (ST905C to ST909C and ST914E to ST914G). Among the steps ST905C to ST909C, the step ST918 is to reset the flag THPOS1 which is representative of the correspondence of the sheet feed sensors and the sheet feed unit.

Referring to FIGS. 20A to 20D, another specific routine is shown which may be adopted in relation to the clutch 27B which is installed in the drive mechanism as shown in FIG. 9. The following description will concentrate on the clutch 27B associated with the sheet cassette 2A by way of example. In the procedure shown in FIGS. 20A to 20D, a step for delivering a command to the clutch 27B is provided in specific portions to implement the same functions as those achievable with the sheet feed motor alone as shown in FIGS. 7 and 8.

Figure 21:
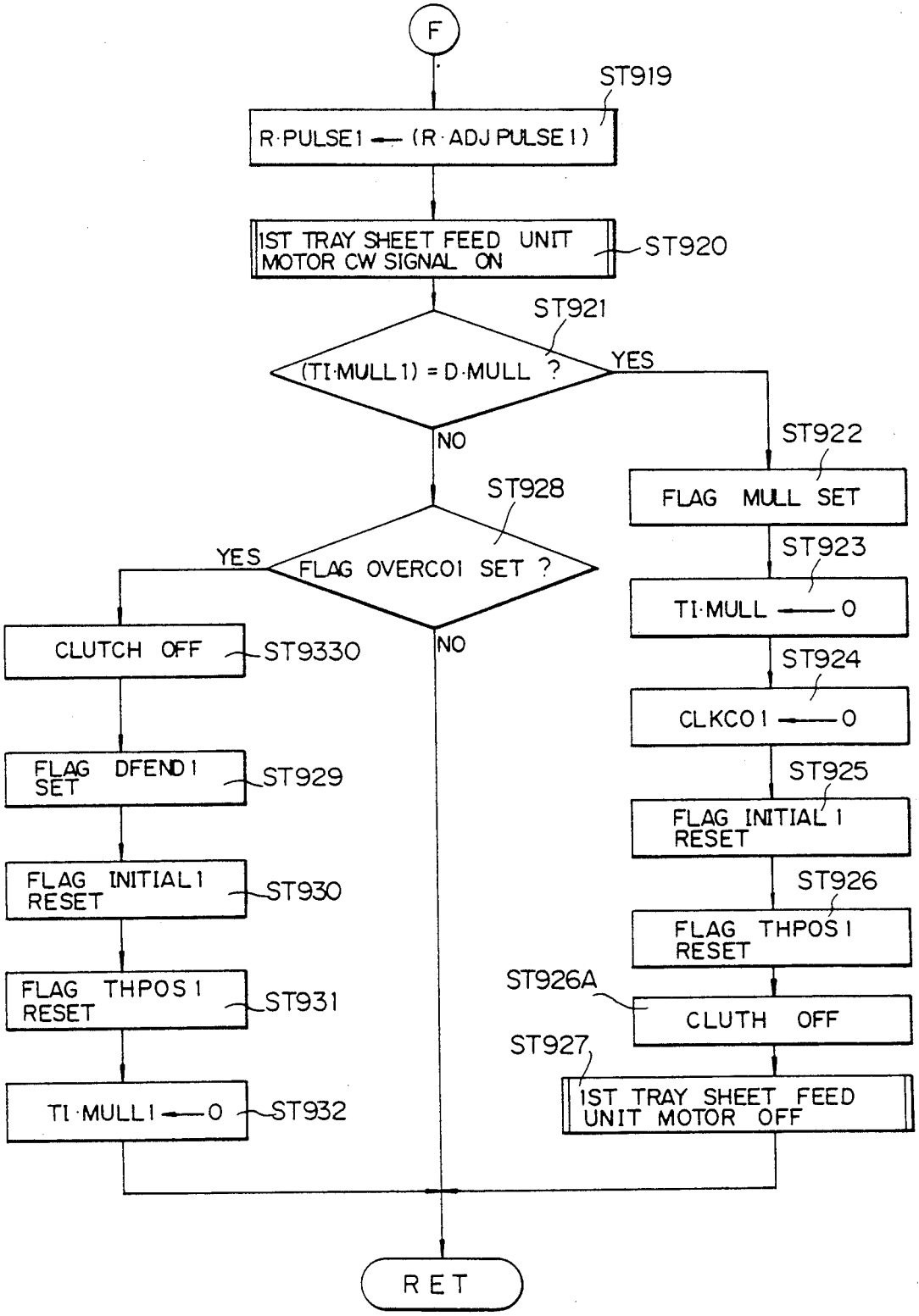

In any of the routines described above, as soon as the processing which occurs when the sheet feed unit 10 aligns with any of the sheet width sensors is completed, a procedure shown in FIG. 21 is executed. Specifically, drive pulses for the sheet feed unit drive motor are stored in the non-volatile memory portion R. PULSE1 of the RAM32 (ST919), and the sheet feed unit drive motor is driven in a predetermined direction on the basis of the content of the memory (ST920). Whether or not the sheet feed unit 10 has started moving within a predetermined (desired) period of time is determined (ST921). If the answer of the step ST921 is YES, processing similar to the steps ST905B to ST909B shown in FIG. 19C is executed (ST922 to ST927). A step ST926A is representative of processing associated with the clutch 27B.

If the answer of the step ST921 is NO, a flag OVERCO1 indicating such a condition is checked (ST928), the flag DFEND indicating the set condition of the sheet cassette is set (ST929), a flag for returning the sheet feed unit 10 to the initial position is reset (ST930), a flag indicative of the alignment of the unit 10 with a sheet width sensor is reset, and the predetermined period of time is cleared (ST931 and ST932). A step ST9330 indicates processing associated with the clutch 27B.

Figure 19A:
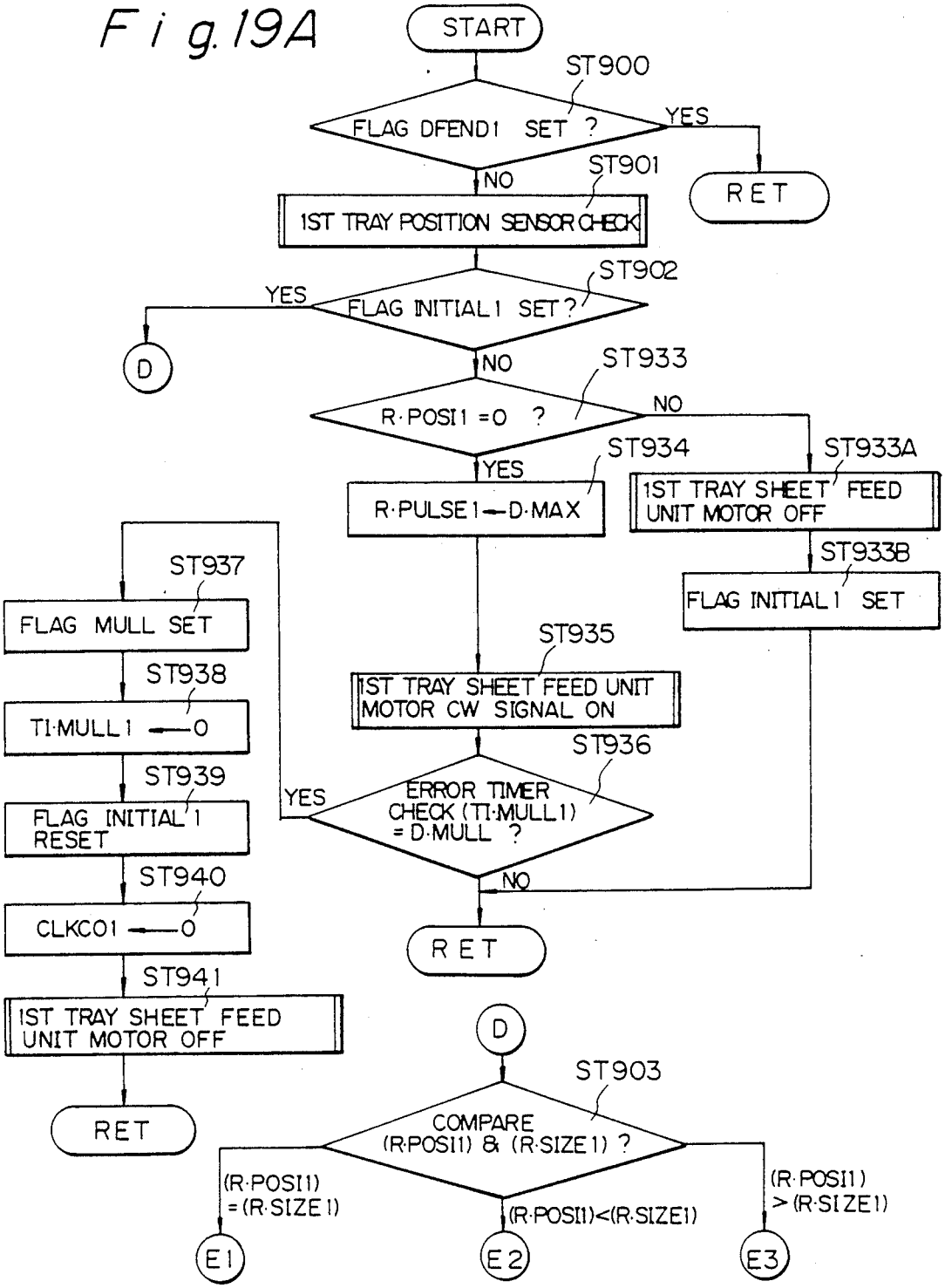
Figure 19B:
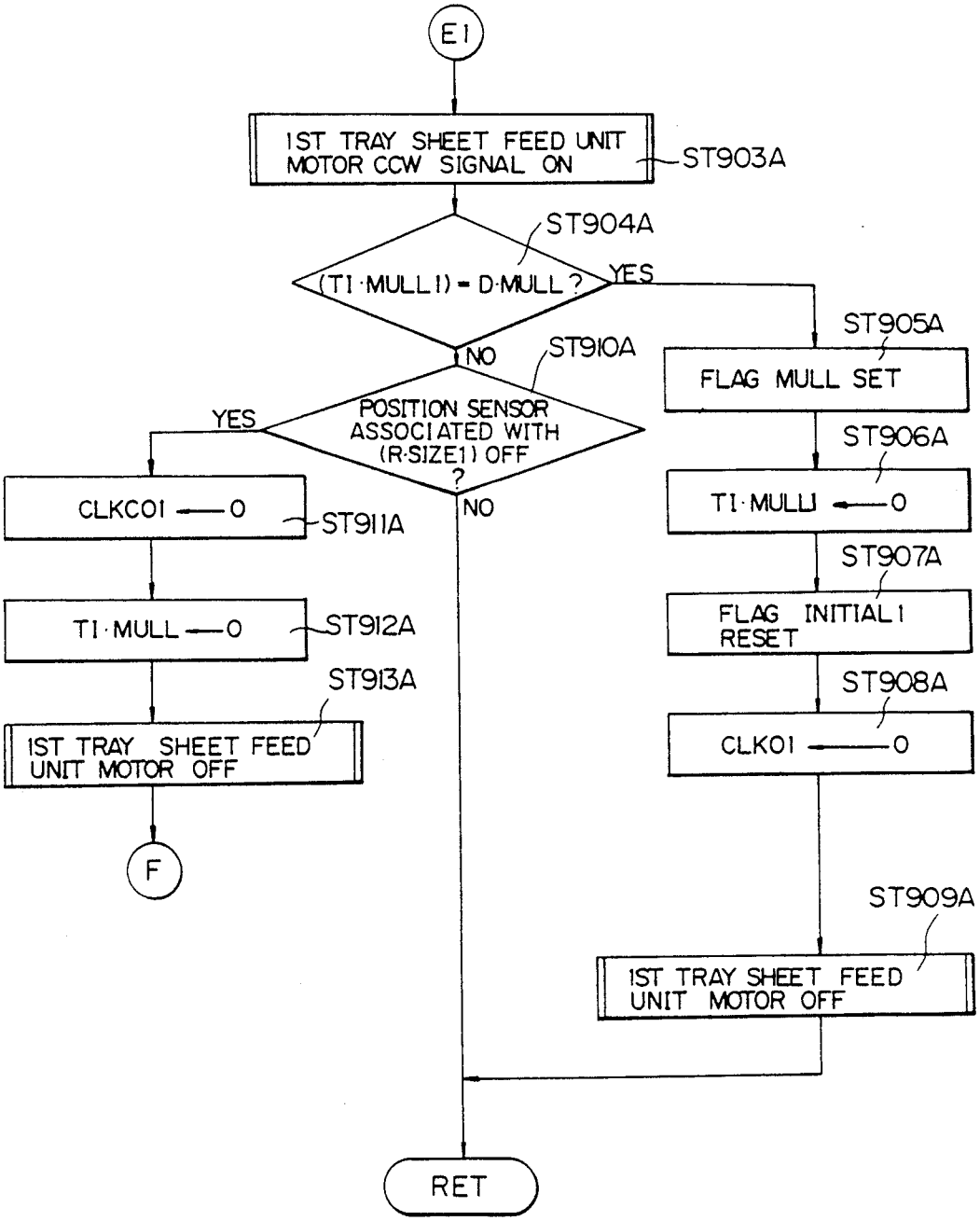
Figure 19C:
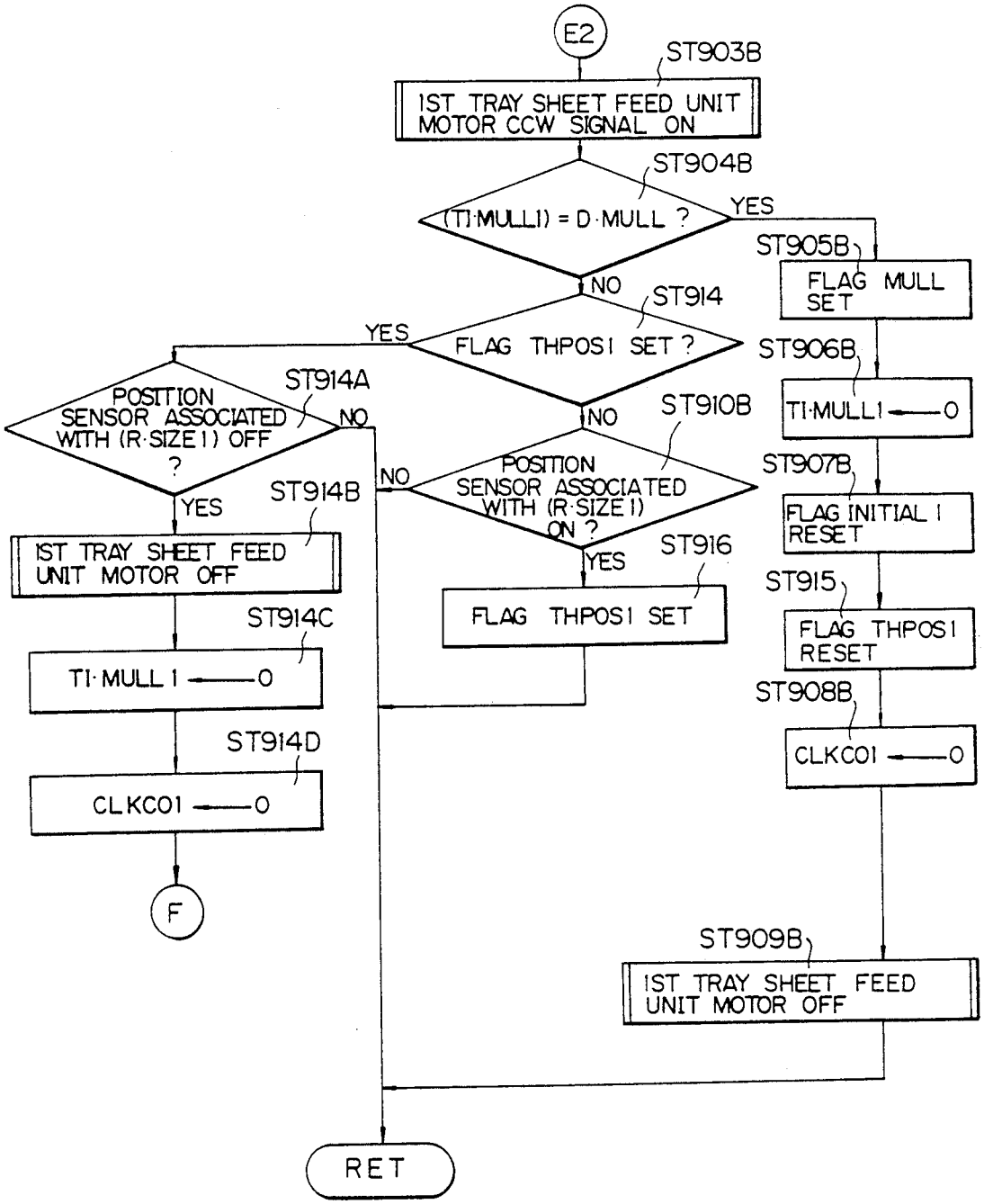
Figure 19D:
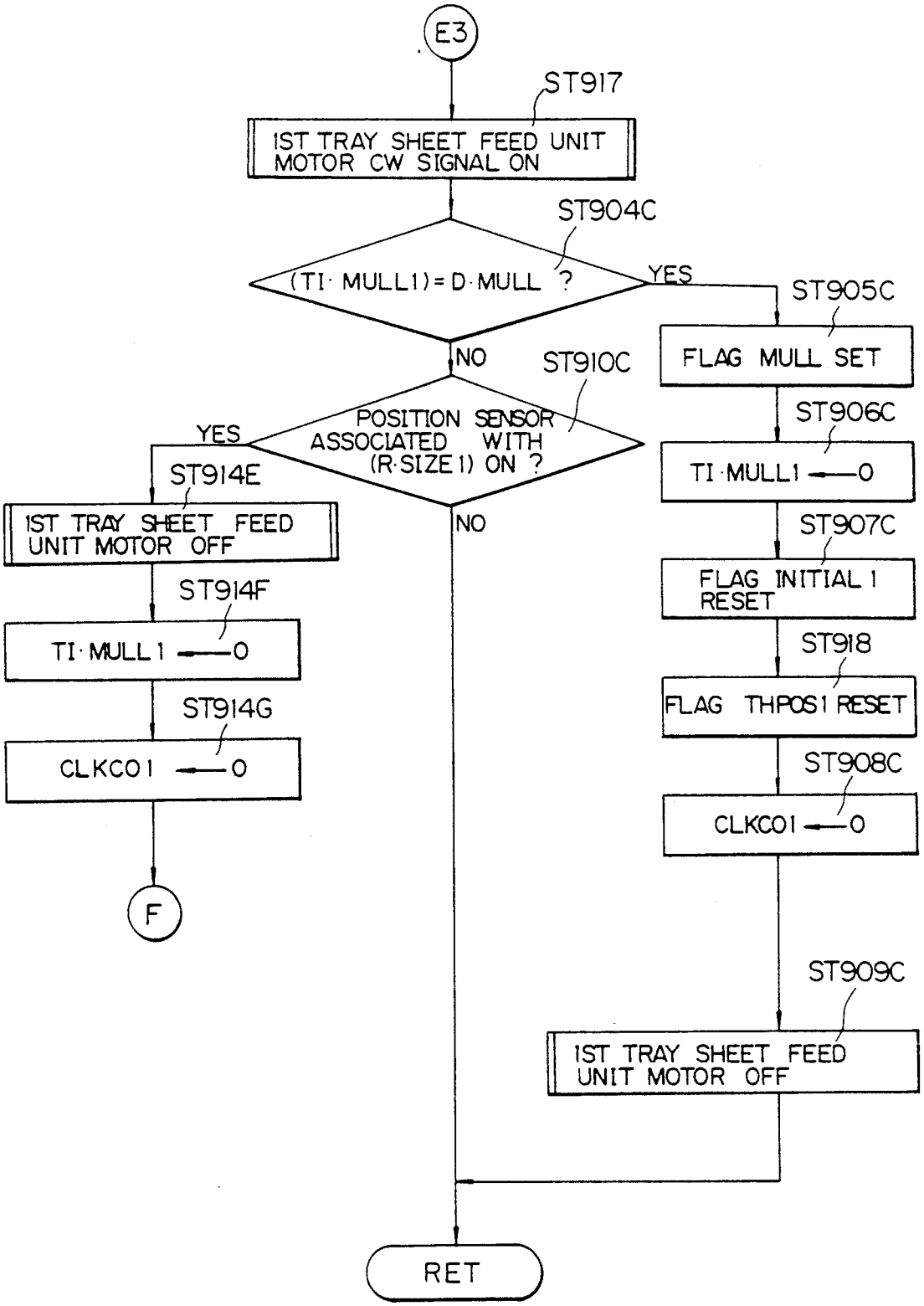
Figure 19E:
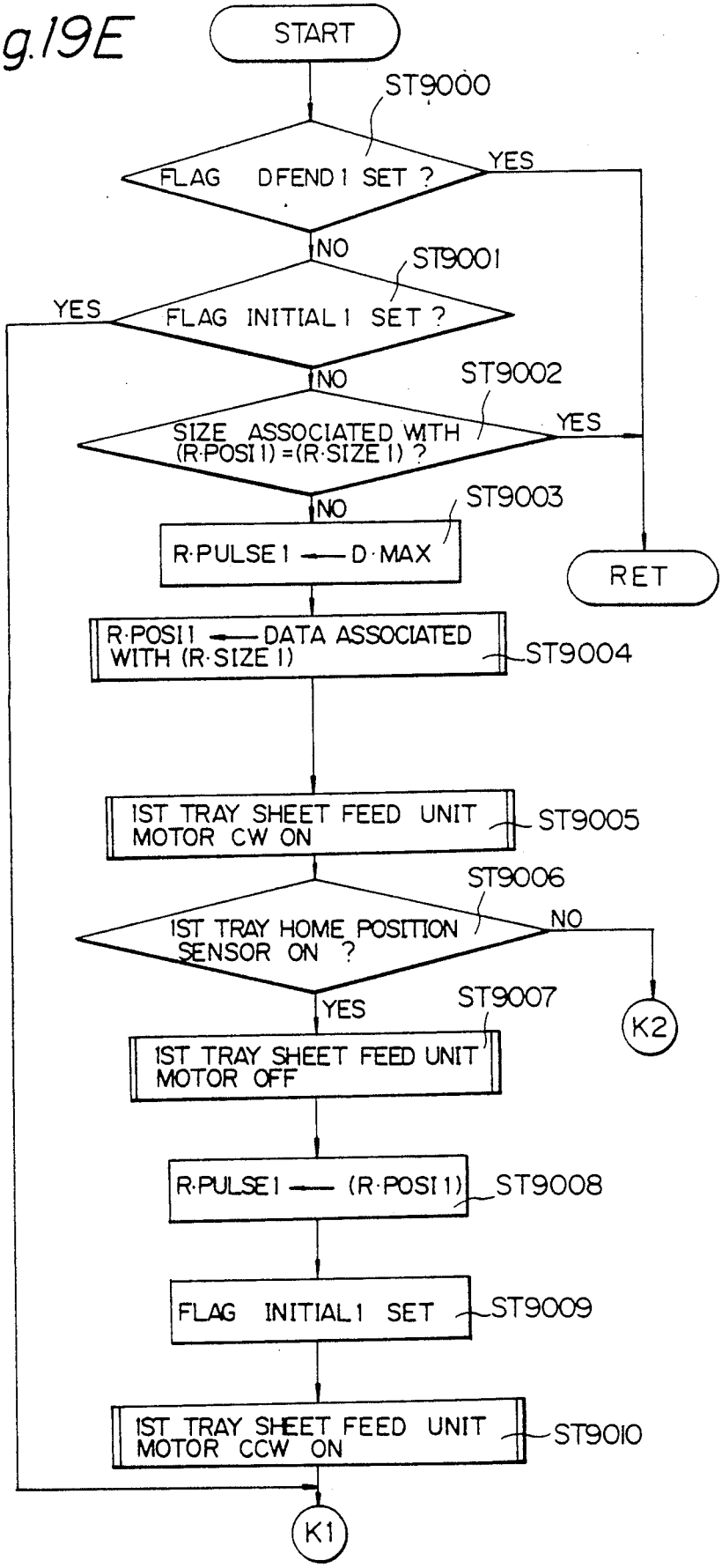

If the sheet feed unit 10 has not been returned to the predetermined position as decided in the step ST902 of FIG. 19A, a flag POSI1 is checked which is to be set when position data from a sheet width sensor with which the unit 10 has aligned is stored (ST933). If the answer of the step ST933 is NO, i.e., when one of the sheet width sensors has outputted position data, the sheet feed unit drive motor is deenergized and a flag INITIAL indicative of a return of the sheet feed unit 10 is set (ST933A and ST933B). If the answer of the step ST933 is YES, i.e., when none of the sheet width sensors produces position data, the maximum amount of drive pulses are applied to the sheet feed unit drive motor (ST934) so that the unit 10 may align with any one of the sheet width sensors. This will drive the motor in a direction for causing the unit 10 to move toward the center of the paper sheets of minimum size in the width-wide direction of the latter (counterclockwise direction in the illustrative embodiment) (ST935). Whether or not the sheet feed unit has actually started moving by being driven by the motor is determined on the basis of the period of time which is used to detect unusual drives as stated above (ST936). If such a period of time has expired, a flag MULL indicating the expiration is set (ST937), a timer for counting this period of time is reset, the flag INITIAL representative of a return of the sheet feed unit 10 is reset, and the drive pulse counter is reset to deactivate the sheet feed unit drive motor (ST938 to ST941).

In the illustrative embodiment, the position sensors 19, 20 and 21 shown in FIG. 7 may be replaced with a home position sensor 19 (see FIG. 7) which is responsive to the initial or home position of the sheet feed unit 10. Then, alternative processing shown in FIGS. 19E to 19F may be executed which determines a target position of the sheet feed unit 10 in terms of the number of drive pulses and which is provided by a return of the unit 10 from the current position to the home position. Specifically, a flag DFEND1 is checked to see if the sheet feed unit 10 is to be moved (ST9000), as in the procedure of FIGS. 19A to 19D and FIG. 21. If the sheet feed unit 10 is not aligned with the home position sensor 19A, the former is moved into alignment with the latter and a flag INITIAL1 is checked (ST9001). If the answer of the ST9001 is NO, i.e., if the sheet feed unit 10 has not been returned to the home position, the number of pulses to be fed to the sheet feed unit drive motor for returning the unit 10 to the home position is stored as data. Whether or not this data is the same as the drive pulses to be fed to sheet feed unit drive motor for moving the unit 10 to the target position is determined (ST9002). If the answer of the step ST9002 is NO, the drive pulses to the sheet feed unit 10 are brought to the maximum condition, the above data is stored in the position R. POSI1 of the RAM 32 (ST9003 and ST9004), and the sheet feed unit drive motor is rotated in a direction for causing the unit 10 into alignment with the home position sensor 19A (ST9005). Then, the sheet feed unit 10 begins to return to the home position. Whether or not the unit 10 has reached the home position is determined on the basis of the output of the home position sensor 19A (ST9006). If the home position sensor 19A is in an ON state, the sheet feed unit drive motor is deenergized (ST9007), the number of pulses fed to the motor for completing the return is written in the area R. POSI1 of the RAM 32 (ST9008), the flag NITIAL1 is set to show that the return to the home position has been completed (ST9009), and a particular number of drive pulses associated with the stroke to the target position are applied to the sheet feed unit drive motor to drive the motor in the opposite direction (ST9010).

Figure 19F:
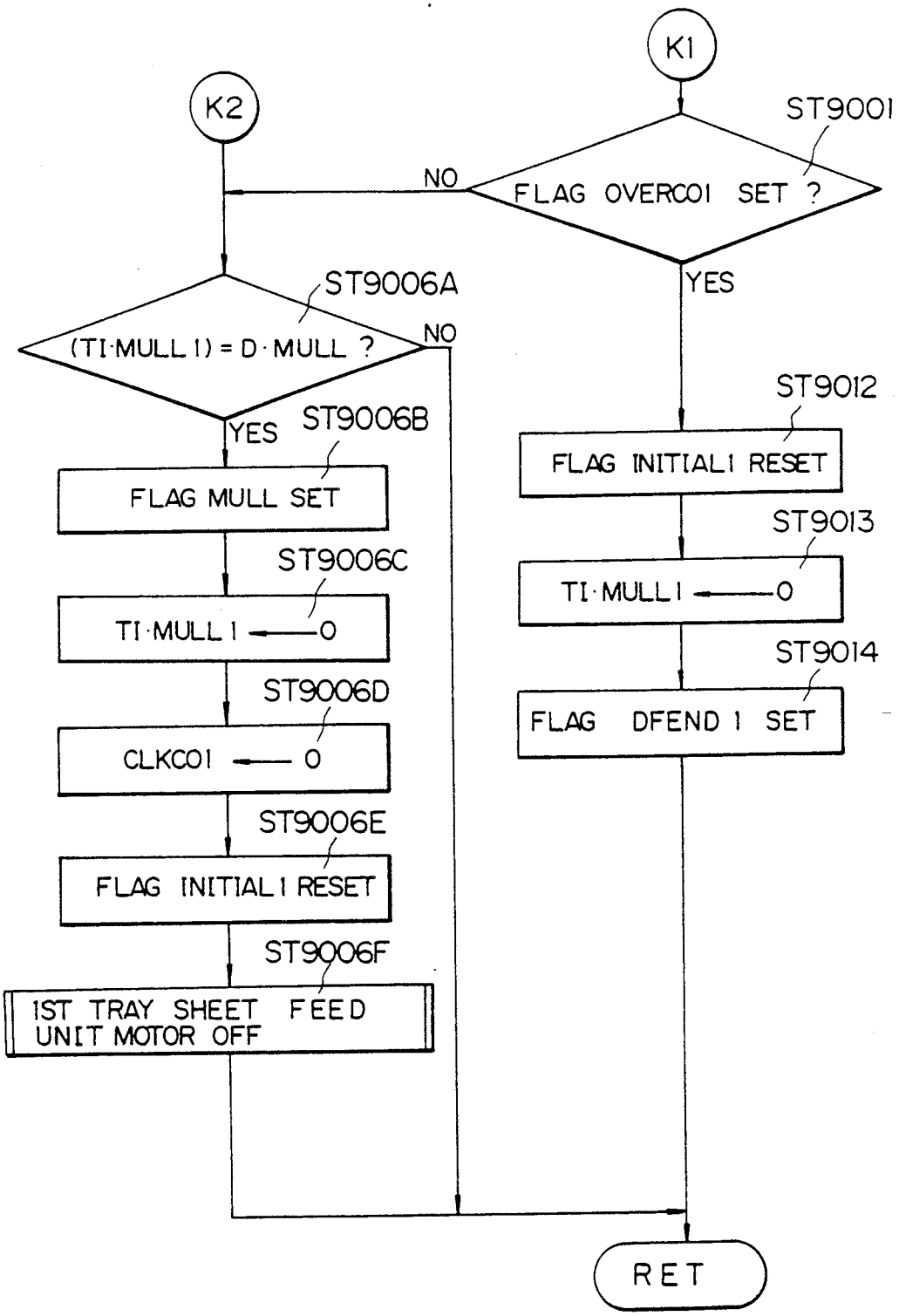
Figure 20B:
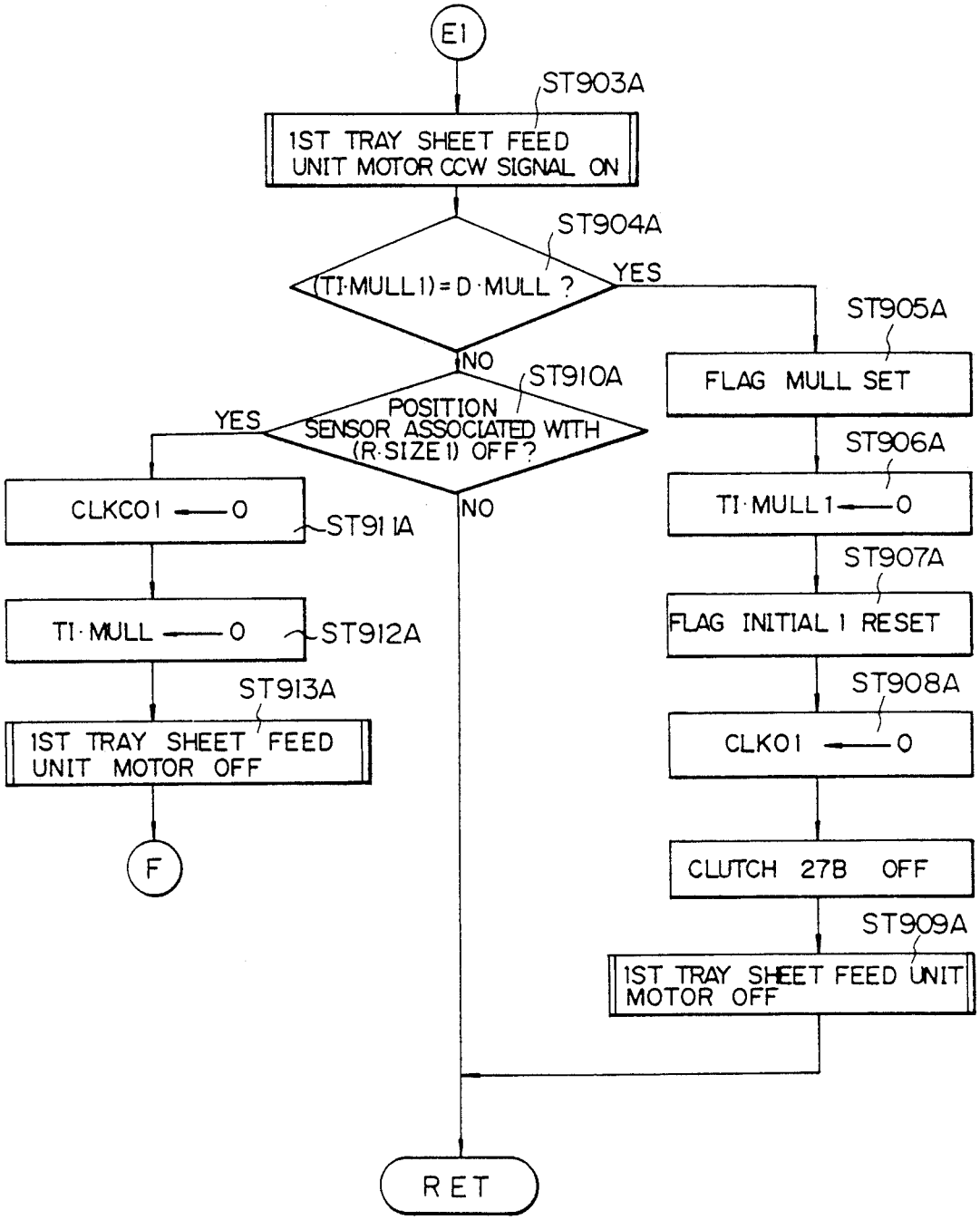
Figure 20C:
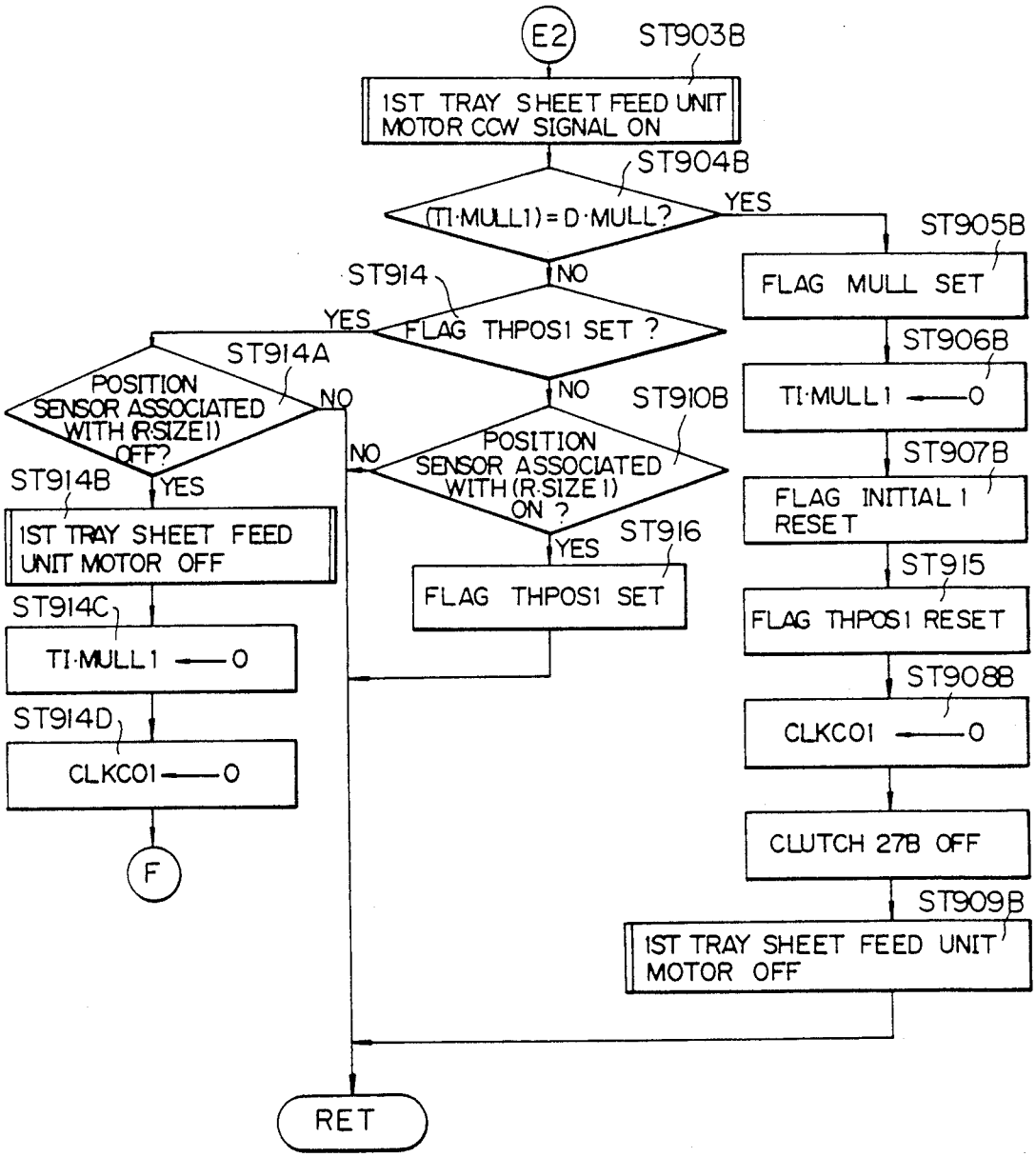
Figure 20D:
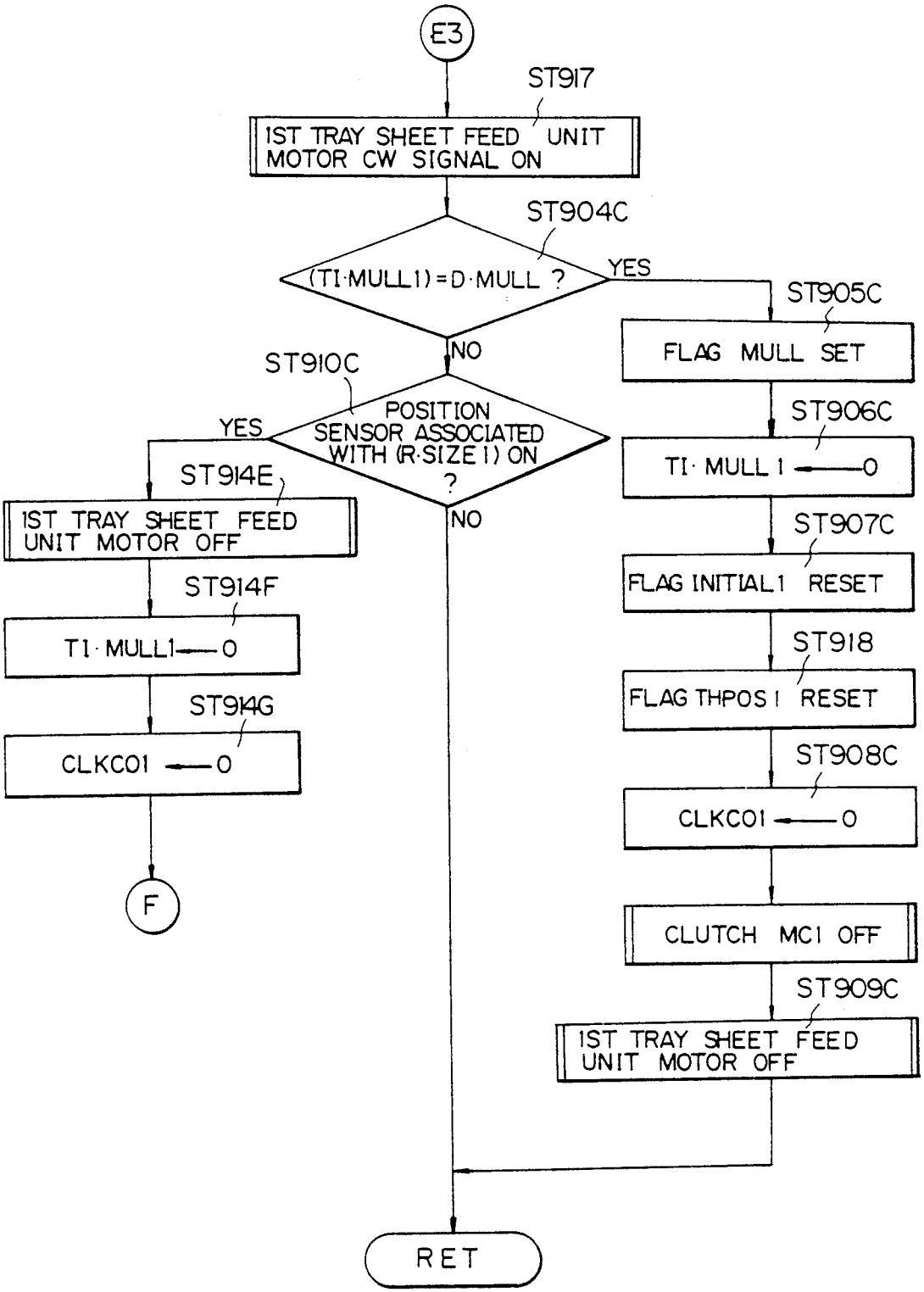

When the answer of the step ST9006 is NO, the program is transferred to a procedure shown in FIG. 19F. In FIG. 19F, whether or not the sheet feed unit 10 has started moving within a predetermined period of time is determined (ST9006A). If the answer of the step ST9006A is YES, meaning that some error has occurred, a flag MULL indicative of the expiration of time is set and the timer is cleared (ST9006B and ST9006C), the drive pulse counter is cleared, processing for indicating that the return has not been completed is executed, and the sheet feed unit drive motor is deenergized (ST9006D to ST9006F).

When the sheet feed unit drive motor is rotated in the step ST9010, a flag OVERCO1 indicating that a predetermined number of drive pulses have appeared is checked (ST9011). If the predetermined number of drive pulses have appeared, the program determines that a normal movement is under way and resets the flag INITIAL indicative of the return of the motor to the home position, clears the timer responsive to the start of movement, and executes processing associated with the ready state of the sheet feed unit 10 (ST9012 to ST9014).

As described above, the alternative procedure drives the sheet feed unit 10 to target position by calculating a stroke to the target position on the basis of a fixed reference, i.e., a home position. The calculation is, therefore, easy to perform.

Figure 22:
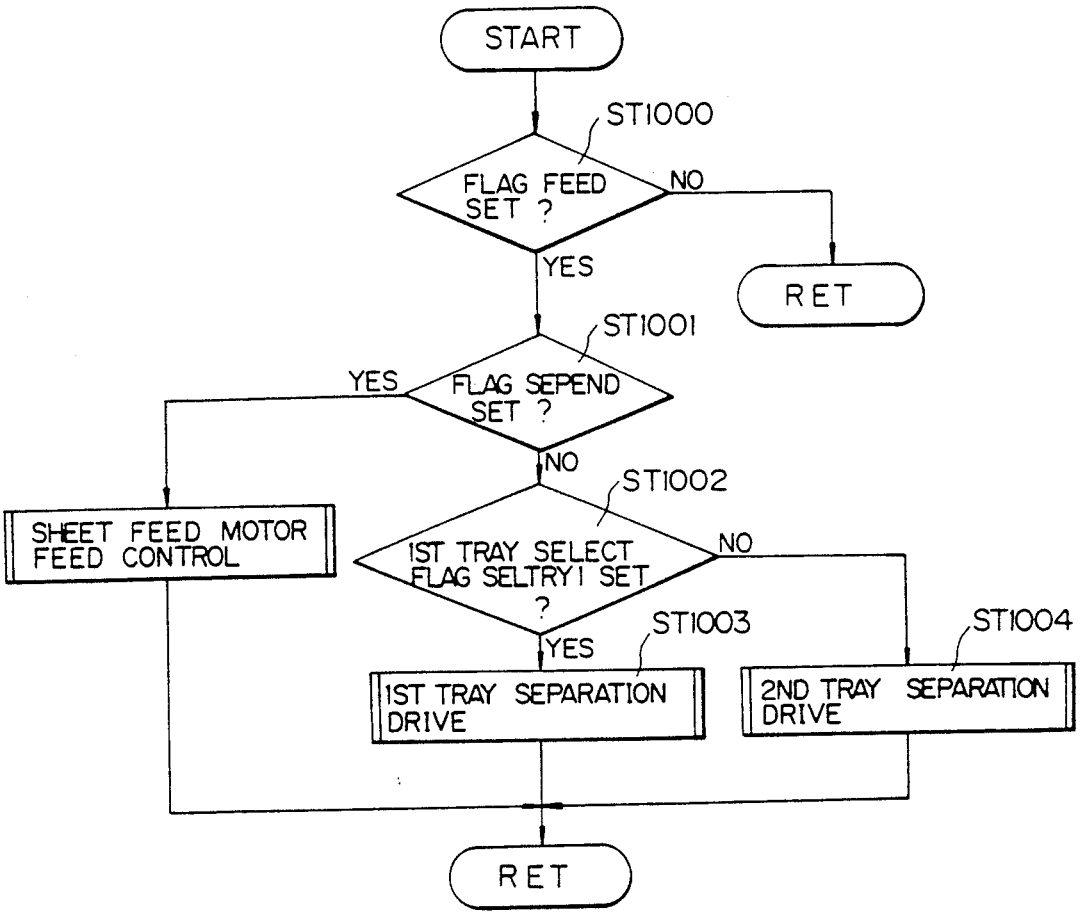

Referring to FIG. 22, the sheet feeder control (II) included in the main routine is shown in detail. The procedure of FIG. 22 is applied to the sheet feed unit drive motor (motor 18, FIGS. 7 and 8) and the feed motor (motor 22, FIGS. 7 and 9) for feeding paper sheets one by one out of the table of the sheet cassette. While the sequence of steps shown in FIG. 22 is concentrated on the sheet cassette 2A, it will be apparent that such a sequence also applies to the sheet cassette 2B. Specifically, the sheet feeder control (II) routine begins with a step ST1000 for checking a flag FEED which is indicative of a sheet feed request, i.e., for determining whether or not the control timing in a copying process has coincided with a sheet feed timing. A paper sheet is separated from the stack first, and then an operation for paying it out is performed. In detail, a flag SEPEND indicative of the end of sheet separation is checked (ST1001) and, if the answer of the step ST1001 is YES, a sheet feed motor control routine is executed. If it is NO, a flag idicative of the kind of a selected sheet cassette is checked (ST1002). Since in the illustrative embodiment the sheet cassette 2A has been selected, a flag SELTRY1 associated with the cassette 2A is checked. In response to the result of the step ST1002, sheet separation is controlled on either one of the tables (ST1003 or ST1004).

Figure 23:
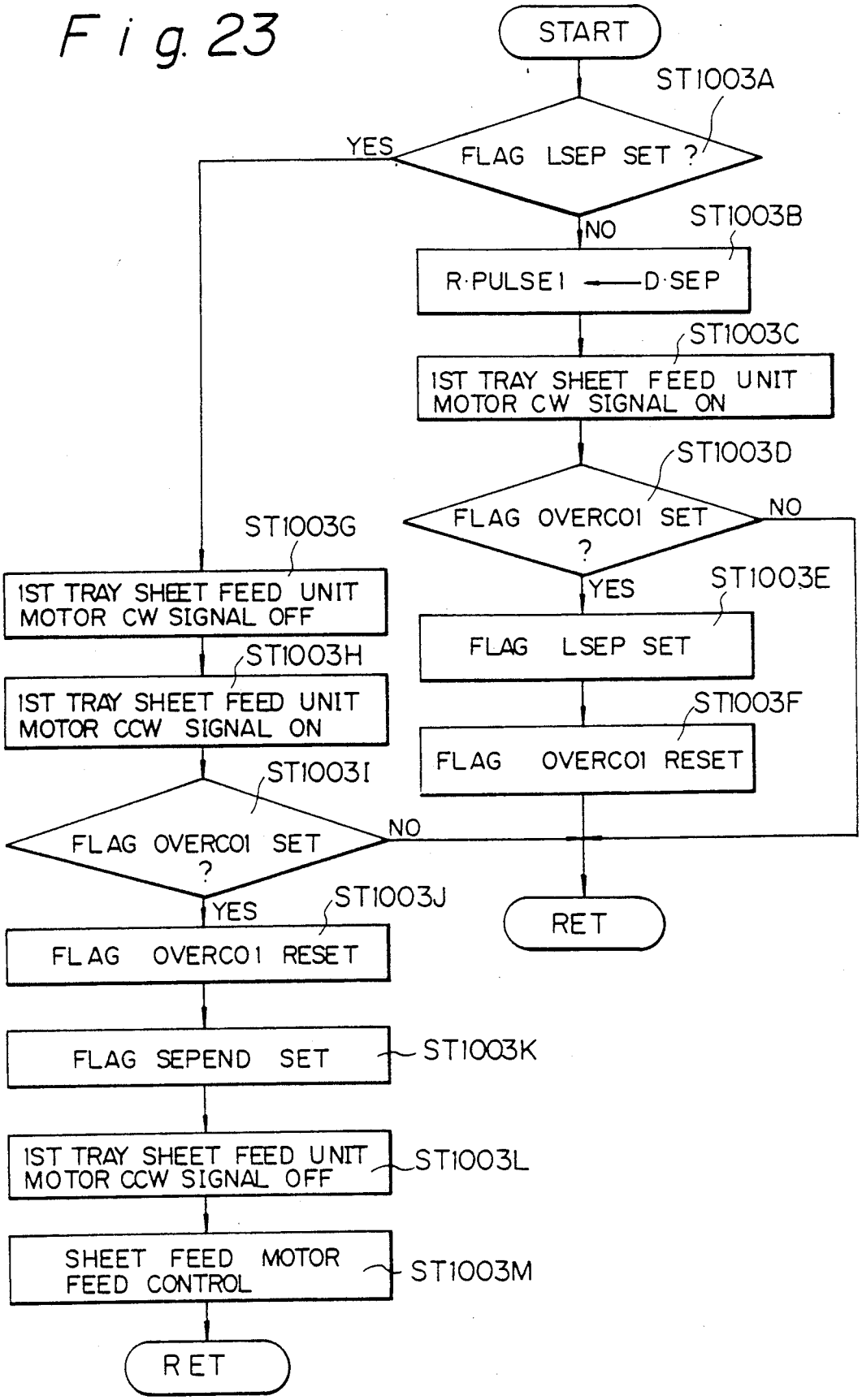

FIG. 23 shows a routine for controlling the separation of a paper sheet on the above-stated first table (referred to as first tray in the figure). As shown, a flag LSEP indicative of the initial position of the sheet feed unit 0, i.e., a home position corresponding to the center of paper sheets of a minimum size is checked (ST1003A). If this flag is not set, i.e., when the sheet feed unit 10 has not reached the home position, a desired number of drive pulses are applied to the sheet feed unit drive motor to move the unit 10 toward the minimum sheet size position (ST1003B and ST1003C). Whether or not the sheet feed unit 10 has started moving within a predetermined period of time is then determined (ST1003D). If the answer of the ST1003D is YES, the flag LSEP is set to show that the sheet feed unit 10 is in the initial position while the flag OVERCO1 is reset to indicate that a period of time has been set in association with the movement starting time (ST1003E and ST1003F). On the other hand, if the answer of the step ST1003A is YES, the drive command to the sheet feed unit drive motor is interrupted (ST1003G), an amount of rotation associated with a stroke for moving the sheet feed unit 10 to the center of paper sheets as previously stated is set, and then the sheet feed unit drive motor is rotated counterclockwise to start moving the unit 10 at the initial position (ST1003H). Whether or not the sheet feed unit 10 has arrived at the center of paper sheets within a predetermined period of time is then determined (ST1003I). If the answer of the step ST1003I is YES, the time setting flag is reset (ST1003J), a flag for commanding the separation of a paper sheet is set (ST1003K), and the sheet feed unit drive motor is deenergized to start on sheet feed motor feed control (ST1003L and ST1003M).

Figure 24A:
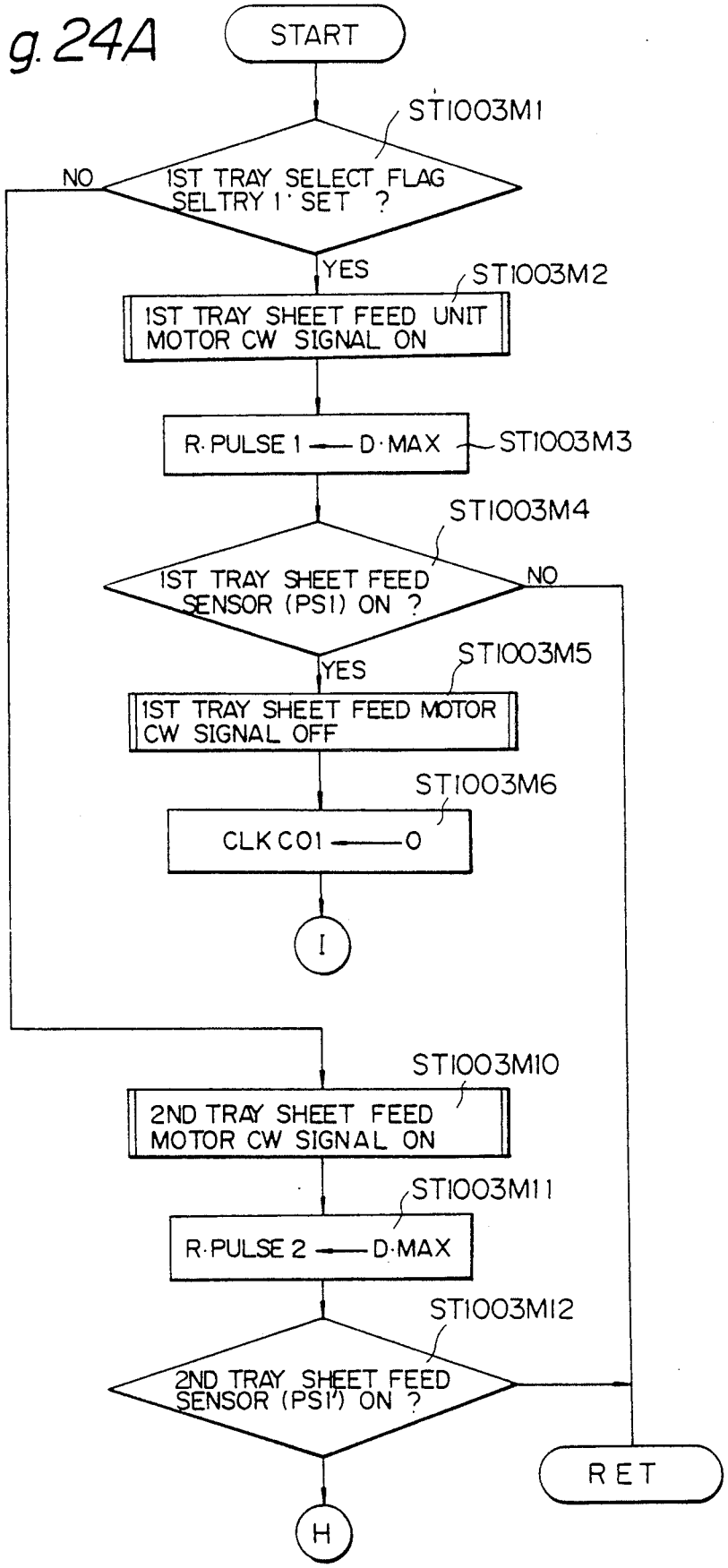
Figure 24B:
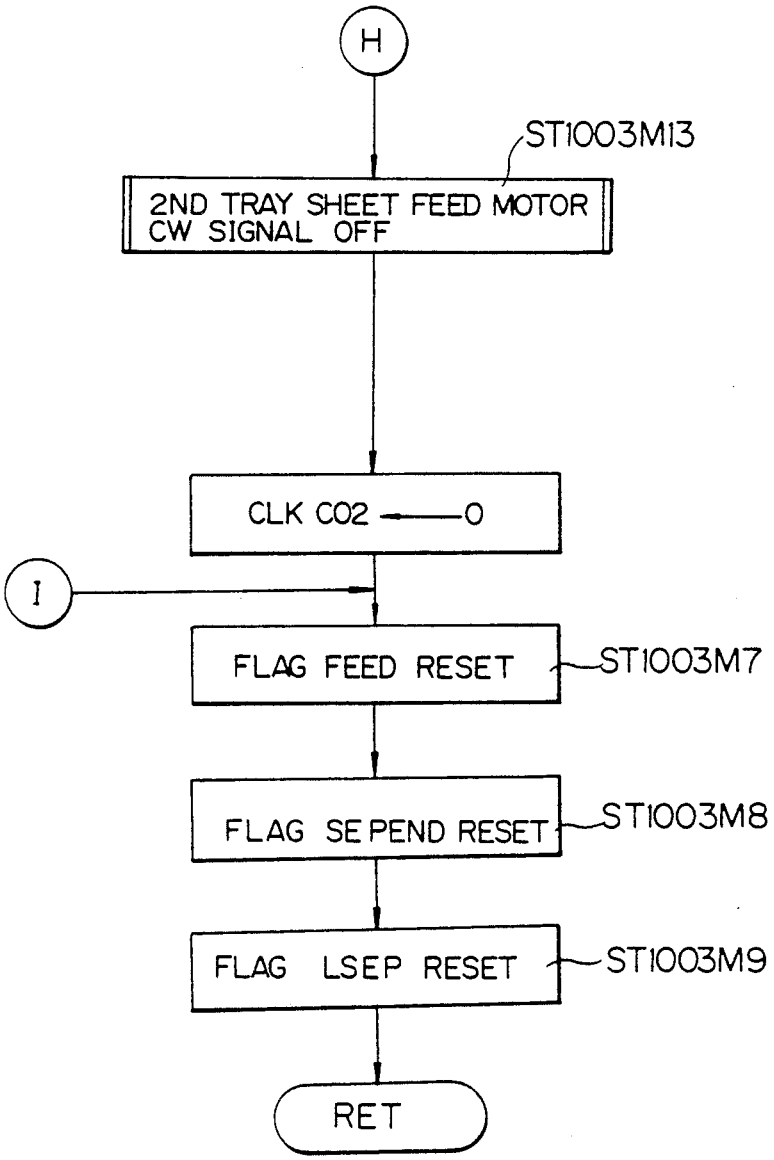

FIG. 24A and 24B show the sheet feed motor feed control specifically. This routine is adapted to control the drive of the feed rollers 10A1 which are mounted on the sheet feed unit 10. Specifically, a flag indicative of the kind of a selected sheet cassette is checked to determine which sheet cassette has been selected (cassette 2A in the specific procedure, ST1003M1). When the cassette 2A is selected, the sheet feed motor 22 associated with the sheet feed unit 10 is rotated in a direction for feeding out a paper sheet (AT1003M2). The amount of rotation of the motor 22 is determined on the number of drive pulses which is written in the area R. PULSE1 of the RAM32; in practice, it is such that the trailing edge of a paper sheet reaches a predetermined position after the sheet sensor 9 has sensed the paper sheet. As soon as the motor 22 pays out a paper sheet, whether the sheet has passed is determined (ST1003M4). If the answer of the step ST1003M4 is YES, the motor 22 is deenergized (ST1003M5) and the drive pulse counter is reset (ST1003M6). When the setting associated with the drive of the motor 22 is completed, the flag FEED is reset, the flag SEPEND is reset, and the flag LSEP is reset to restore the motor 22 to the initial setting (ST1003M7 to ST1003M9).

When the answer of the step ST1003M1 is NO, the program determines that in the illustrative embodiment the sheet cassette 2B has been elected. Then, the above-described sequence of steps are effected with the sheet feed unit of the cassette 2B (ST1003M10 to ST1003M12).

Figure 25A:
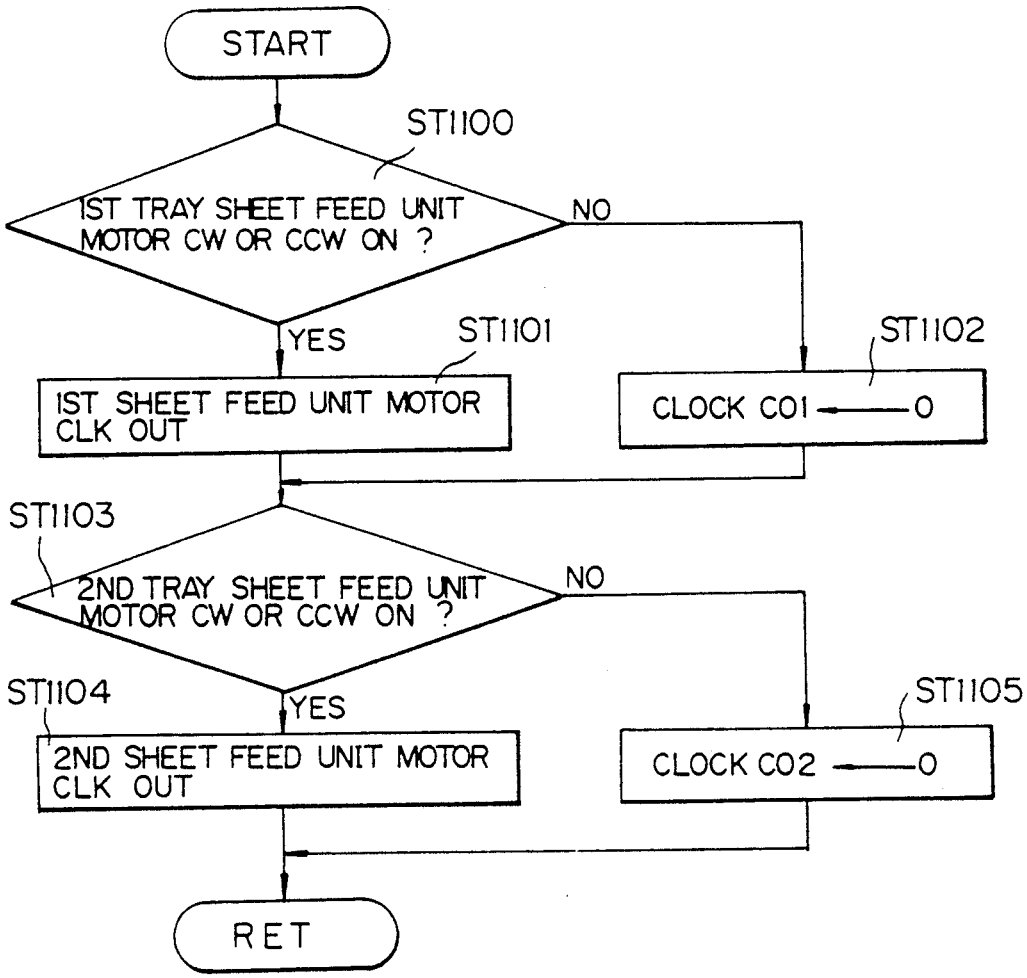

Referring to FIGS. 25A, 25B, 26A and 26B, a subroutine included in the program of the illustrative embodiment for promoting accurate drive of the motors 18, 23A and 22 is shown. In the illustrative embodiment, this program is implemented by an interrupt routine which occurs every 10 milliseconds. As shown in FIG. 25A, when the program is applied to the sheet feed unit 10 of the cassette 2A, whether or not a clockwise or a counterclockwise drive signal in the form of pulses for driving the motors 18 and 23A (see FIGS. 7 and 9) has been applied is determined (ST1100). If the answer of the step ST1100 is YES, sheet feed unit drive motor CLK OUT processing, which will be described, is executed (ST1101); if otherwise, a counter for counting drive pulses to the motor is reset (ST1102). Such processing similarly applies to the sheet feed unit drive motor which is included in the sheet cassette 2B (ST1103 to ST1105).

The sheet feed unit drive motor CLK OUT processing is executed to deliver any desired number of pulses stored in the area R. PULSE1 of the RAM 32 to the sheet feed unit drive motor every 10 seconds. Specifically, that the sheet feed unit drive motor is in operation is determined on the basis of the output of the clock signal (ST1106). If the answer of the step ST1106 is NO, the clock signal is turned to an ON state (ST1107) and a timer value associated with any desired period of time preselected to detect errors of the sheet feed unit and the clock signal are incremented every 10 milliseconds (ST1108 and ST1109). Whether the number of clock signals has coincided with the number of drive pulses stored in the RAM 32 is determined (ST1110). If the answer of the step ST1110 is YES, the sheet feed unit drive motor is deenergized to stop the movement of the sheet feed unit while various data associated with the drive are restored to initial (ST1111 to ST1114).

Figure 25B:
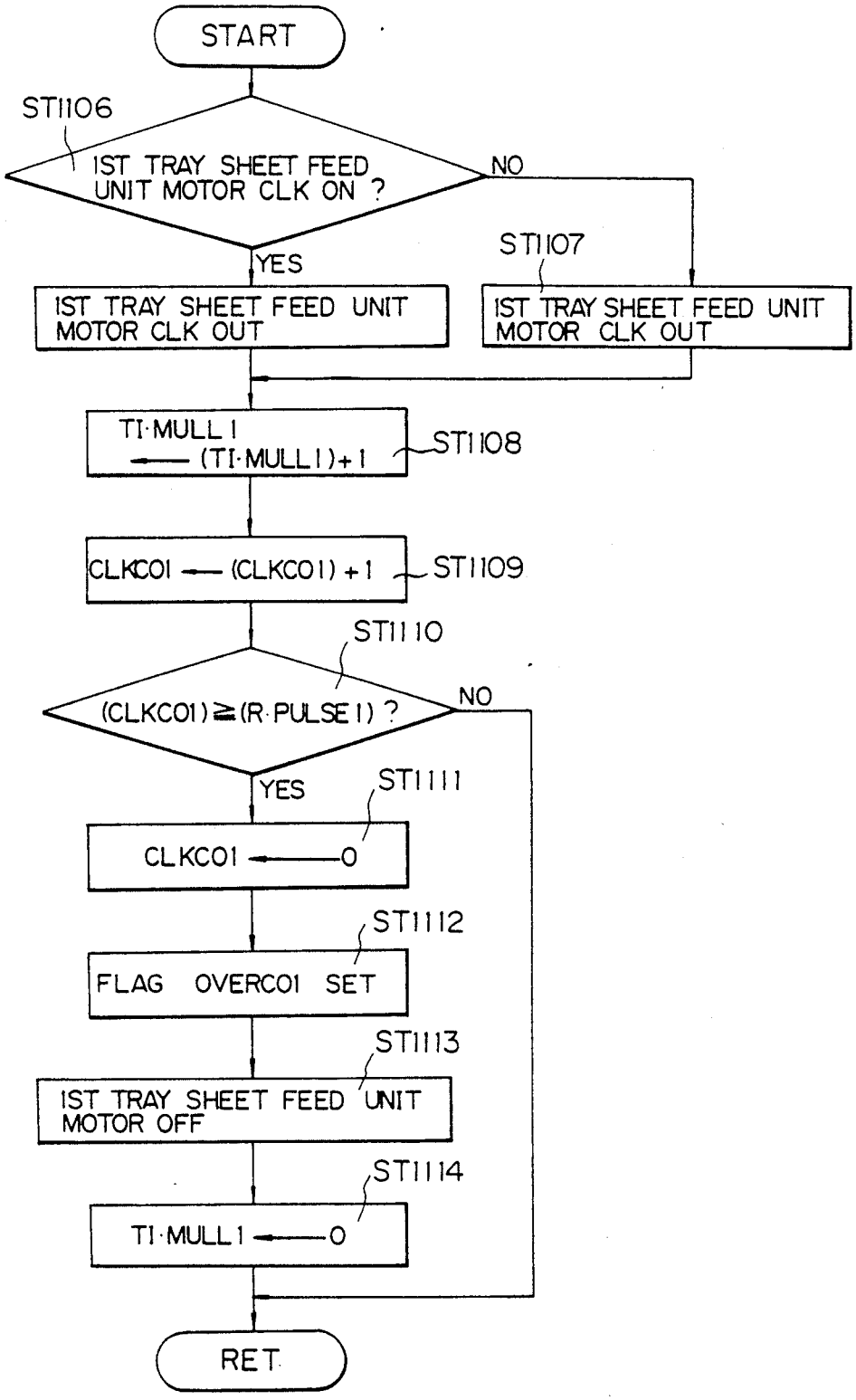
Figure 26A:
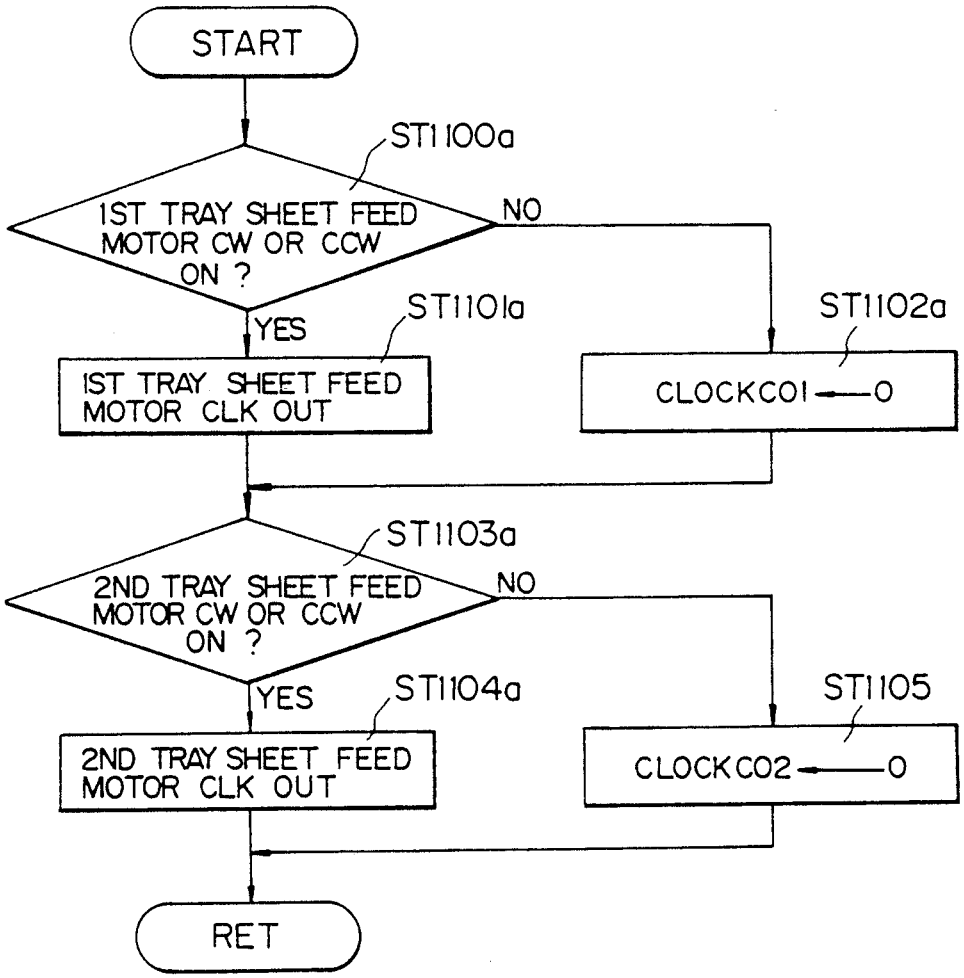
Figure 26B:
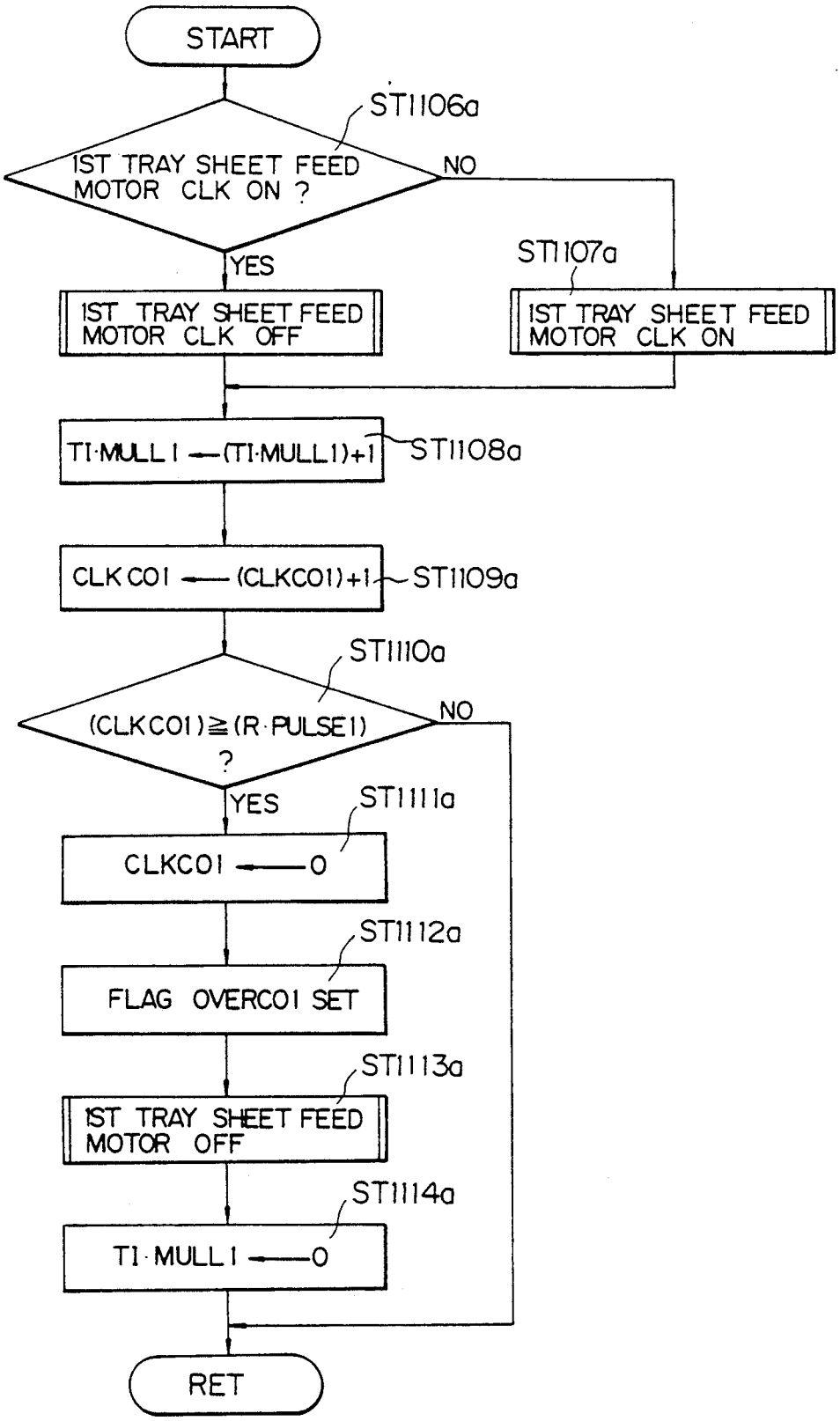

Regarding the sheet feed motor 22, the procedure discussed with reference to FIGS. 25A and 25B is also executed except for the replacement of the sheet feed motor 22 for the sheet feed unit drive motor. Hence, the steps associated with the sheet feed motor 22 shown in FIGS. 26A and 26B are distinguished by small letters affixed to the numbers.

In summary, it will be seen that the present invention provides a sheet feeder for an image forming apparatus which, by sensing the size of paper sheets stacked on a sheet cassette, automatically locates a sheet feed unit having feed rollers at the center of the paper sheets in the widthwise direction of the latter. This automatically sets up a sheet feed condition which has a reference at the center, while allowing paper sheets to be positioned in a sheet cassette with respect to one side only. The image forming apparatus with such a sheet feeder enhances efficient manipulations for a sheet feed and guarantees accurate transport of paper sheets.

Various modifications will become possible for those skilled in the art after receiving the teachings of the present disclosure without departing from the scope thereof.

What is claimed is:

1. A sheet feeder for an image forming apparatus having a sheet feed unit which incorporates a pair of feed rollers for feeding paper sheets one by one out of at least one sheet cassette toward an image transfer station by nipping said paper sheets, said sheet feeder comprising:

guide means for slidably guiding said sheet feed unit in a direction perpendicular to an intended direction of sheet feed while supporting said sheet feed unit;

drive means for moving said sheet feed unit which is guided by said guide means; and a controller for controlling said guide means and said drive means such that said sheet feed unit is movable, thereby causing said feed rollers to move into alignment with a center position between opposite widthwise edges of the paper sheets, in association with a size of said paper sheets which are fed toward the image transfer station.

2. A sheet feeder as claimed in claim 1, further comprising sheet size sensing means arranged on the sheet cassette in a widthwise direction of the paper sheets which is perpendicular to the intended direction of sheet feed for sensing a size of said paper sheets which are loaded on said sheet cassette.

3. A sheet feeder as claimed in claim 2, wherein said sheet size sensing means comprises a plurality of sensors corresponding in number to the number of sizes of the paper sheets which may be loaded on said sheet cassette.

4. A sheet feeder as claimed in claim 2, further comprising sheet feed unit position sensing means for sensing a position of said movable sheet feed unit.

5. A sheet feed as claimed in claim 4, wherein said sheet feed unit position sensing means comprises a plurality of sensors arranged on a locus of movement of said sheet feed unit and in positions which are determined by the sizes of the paper sheets to be sensed by said sheet size sensing means.

6. A sheet feed as claimed in claim 4, wherein said control means controls said drive means and said guide means such that the center position between the opposite widthwise edges of the paper sheets is calculated in association with the sheet size sensed by said sheet size sensing means, and said sheet feed unit is guided by said guide means to the center position between the opposite widthwise edges.

7. A sheet feeder for an image forming apparatus having a sheet feed unit which incorporates a pair of feed rollers for feeding paper sheets one by one out of at least one sheet container toward an image transfer station by nipping said paper sheets, said sheet feeder comprising:

a sheet cassette as said sheet container, wherein said paper sheets are positioned in said sheet cassette with respect to one side of said paper sheets only;

guide means for slidably guiding said sheet feed unit in a direction perpendicular to an intended direction of sheet feed while supporting said sheet feed unit;

drive means for moving said sheet feed unit which is guided by said guide means; and a controller for controlling said guide means and said drive means such that said sheet feed unit is movable, thereby causing said feed rollers to move into alignment with a center position between opposite widthwise edges of the paper sheets, in association with a size of said paper sheets which are fed toward the image transfer station.

8. A sheet feeder as claimed in claim 7, further comprising sheet size sensing means arranged on the sheet cassette in a widthwise direction of the paper sheets which is perpendicular to the intended direction of sheet feed for sensing a size of said paper sheets which are located on said sheet cassette.

9. A sheet feeder as claimed in claim 8, wherein said sheet size sensing means comprises a plurality of sensors corresponding in number to the number of sizes of the paper sheets which may be loaded on said sheet cassette.

10. A sheet feeder as claimed in claim 8, further comprising sheet feed unit position sensing means for sensing a position of said movable sheet feed unit.

11. A sheet feed as claimed in claim 10, wherein said sheet feed unit position sensing means comprises a plurality of sensors arranged on a locus of movement of said sheet feed unit and in positions which are determined by the sizes of the paper sheets to be sensed by said sheet size sensing means.

12. A sheet feed as claimed in claim 10, wherein said control means controls said drive means and said guide means such that the center position between the opposite widthwise edges of the paper sheets is calculated in association with the sheet size sensed by said sheet size sensing means, and said sheet feed unit is guided by said guide means to the center position between the opposite widthwise edges.

* * * * *